US006233925B1

(12) United States Patent
Hirota et al.

(10) Patent No.: US 6,233,925 B1
(45) Date of Patent: May 22, 2001

(54) EXHAUST DISCHARGE CONTROL DEVICE FOR INTERNAL COMBUSTION ENGINE

(75) Inventors: Shinya Hirota, Susono; Toshiaki Tanaka, Numazu; Satoshi Iguchi, Mishima, all of (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 0 days.

(21) Appl. No.: 09/368,689

(22) Filed: Aug. 5, 1999

(30) Foreign Application Priority Data

Aug. 28, 1998 (JP) ..... 10-243391
Sep. 10, 1998 (JP) ..... 10-257277

(51) Int. Cl.[7] ..... F01N 3/00

(52) U.S. Cl. ..... 60/285; 60/286; 60/287; 60/292; 60/297; 60/324

(58) Field of Search ..... 60/285, 295, 297, 60/287, 288, 289, 324, 291, 292, 286, 300, 301; 123/443

(56) References Cited

U.S. PATENT DOCUMENTS 5,472,673 * 12/1995 Goto et al. ..... 422/169
5,657,625 * 8/1997 Koga et al. ..... 60/274
5,758,493 * 6/1998 Asik et al. ..... 60/274
5,778,666 * 7/1998 Cullen et al. ..... 60/274
5,974,788 * 11/1999 Hepburn et al. ..... 60/274
6,014,859 * 1/2000 Yoshizaki et al. ..... 60/285
6,023,929 * 2/2000 Ma ..... 60/295
6,122,910 * 9/2000 Hoshi et al. ..... 60/297

FOREIGN PATENT DOCUMENTS 6-88518 3/1994 (JP) .
6-129239 5/1994 (JP) .
2600492 1/1997 (JP) .

* cited by examiner

*Primary Examiner*—Thomas Denion
*Assistant Examiner*—Binh Tran
(74) *Attorney, Agent, or Firm*—Kenyon & Kenyon

(57) ABSTRACT

An $NO_x$ absorbent is arranged in an engine exhaust passage absorbs $NO_x$ when the air-fuel ratio of inflowing exhaust gas is lean and discharges absorbed $NO_x$ or $SO_x$ when the oxygen concentration of inflowing exhaust gas decreases. When the air-fuel ratio of the exhaust gas flowing into the $NO_x$ absorbent is rich, previously absorbed $NO_x$ or $SO_x$ is discharged from the $NO_x$ absorbent. When $NO_x$ or $SO_x$ is to be discharged from the $NO_x$ absorbent, oxygen is left in the exhaust gas flowing into the $NO_x$ absorbent and the oxygen concentration of this exhaust gas is maintained within a predetermined range.

15 Claims, 16 Drawing Sheets

EXHAUST DISCHARGE CONTROL DEVICE FOR INTERNAL COMBUSTION ENGINE

INCORPORATION BY REFERENCE

The disclosure of Japanese Patent Applications No. HEI 10-243391 filed on Aug. 28, 1998 and No. HEI 10-257277 filed on Sep. 10, 1998, including the specification, drawings and abstract, is incorporated herein by reference in their entirety.

BACKGROUND OF THE INVENTION

1. Field of the Invention

The present invention relates to an exhaust discharge control device for an internal combustion engine.

2. Description of the Related Art

It is assumed that the ratio of the entire air amount to the entire amounts of fuel and a reducing agent supplied into an exhaust passage, a combustion chamber and an intake passage upstream of a certain position within the exhaust passage is referred to as an air-fuel ratio of an exhaust gas flowing at that position. Here, there is a known exhaust discharge control device for an internal combustion engine that allows burning of a lean air-fuel mixture gas, in which an $NO_x$ absorbent that absorbs $NO_x$ if the air-fuel ratio of the inflowing exhaust gas is lean and discharges the absorbed $NO_x$ if the oxygen concentration of the inflowing exhaust gas is low, is disposed in the exhaust passage of the internal combustion engine such that the air-fuel ratio of the exhaust gas flowing into the $NO_x$ absorbent is made rich or a stoichiometric air fuel ratio temporarily to discharge and reduce the absorbed $NO_x$ from the $NO_x$ absorbent (see Japanese Patent Publication No. 2600492).

If the oxygen concentration of the exhaust gas flowing into the $NO_x$ absorbent is reduced, $NO_x$ or $SO_x$ is discharged and removed. Based on this, it is considered that as the oxygen concentration of the exhaust gas flowing into the $NO_x$ absorbent becomes lower, $NO_x$ or $SO_x$ is purified more excellently, and if oxygen is hardly contained in the exhaust gas flowing into the $NO_x$ absorbent, $NO_x$ or $SO_x$ is can be purified further excellently.

SUMMARY OF THE INVENTION

The inventor of the present invention confirmed, however, that $NO_x$ or $SO_x$ in the $NO_x$ absorbent can be better purified in a state where a certain amount of oxygen exists in the $NO_x$ absorbent. It is, therefore, necessary to keep oxygen in the $NO_x$ absorbent when discharging $NO_x$ or $SO_x$ from the $NO_x$ absorbent so as to purify $NO_x$ or $SO_x$ in the $NO_x$ absorber more excellently. The above-cited reference discloses no description with respect to the aforementioned point.

It is an object of the present invention to provide an exhaust discharge control device for an internal combustion engine capable of well purifying $NO_x$ or $SO_x$ in an $NO_x$ absorbent.

To attain the above object, in the present invention, an exhaust discharge control device for an internal combustion engine has an $NO_x$ absorbent that is disposed in an engine exhaust passage, absorbs $NO_x$ if the air-fuel ratio of an inflowing exhaust gas is lean, and discharges the absorbed $NO_x$ if the oxygen concentration of the inflowing exhaust gas decreases, and includes oxygen concentration control means for leaving oxygen in the exhaust gas flowing into the $NO_x$ absorbent if $NO_x$ or $SO_x$ is to be discharged from the $NO_x$ absorbent and for maintaining the oxygen concentration of the exhaust gas within a predetermined range. That is, since oxygen is contained in the exhaust gas flowing into the $NO_x$ absorbent when discharging $NO_x$ or $SO_x$ from the $NO_x$ absorbent, oxygen can be kept within the $NO_x$ absorbent.

In addition, the amount of hydrocarbon adhered onto the $NO_x$ absorbent may be obtained, and the oxygen concentration of the exhaust gas flowing into the $NO_x$ absorbent may be increased so as to discharge more amount of $NO_x$ or $SO_x$ from the $NO_x$ absorbent as the hydrocarbon amount becomes larger. Thus, if oxygen exists in the $NO_x$ absorbent, $NO_x$ or $SO_x$ is well purified in the $NO_x$ absorbent.

Further, the temperature of the $NO_x$ absorbent may be detected such that the oxygen concentration of the exhaust gas flowing into the $NO_x$ absorbent is increased for discharging more amount of $NO_x$ or $SO_x$ from the $NO_x$ absorbent as the temperature becomes higher. That is, the hydrocarbon adhered to the $NO_x$ absorbent reacts with oxygen more actively as the temperature of the $NO_x$ absorbent becomes higher. Also, an oxygen occluding material that stores oxygen if the oxygen concentration of the inflowing exhaust gas increases and discharges the stored oxygen if the oxygen concentration of the inflowing exhaust gas decreases, may be provided in the $NO_x$ absorbent. That is, if the oxygen concentration of the exhaust gas which flows into the $NO_x$ absorbent so as to discharge $NO_x$ or $SO_x$ from the $NO_x$ absorbent decreases, oxygen is discharged from the oxygen occluding material, thus supplying oxygen to the $NO_x$ absorbent.

Moreover, a hydrocarbon absorbent may be provided in the $NO_x$ absorbent. The hydrocarbon absorbent absorbs hydrocarbon when the temperature of the hydrocarbon absorbent becomes low and releases the absorbed hydrocarbon when the temperature of the hydrocarbon absorbent becomes high. That is, if the oxygen concentration of the exhaust gas flowing into the $NO_x$ absorbent is decreased so as to discharge $NO_x$ or $SO_x$ from the $NO_x$ absorbent, the temperature of the inflowing exhaust gas increases. Therefore, hydrocarbon is released from the hydrocarbon absorbent. The hydrocarbon then reacts with oxygen in the $NO_x$ absorbent and is reformed into the reducing agent effective for $NO_x$ and $SO_x$. As a result, excellent purification of $NO_x$ or $SO_x$ is realized.

DESCRIPTION OF THE PREFERRED EMBODIMENTS

Figure 1:
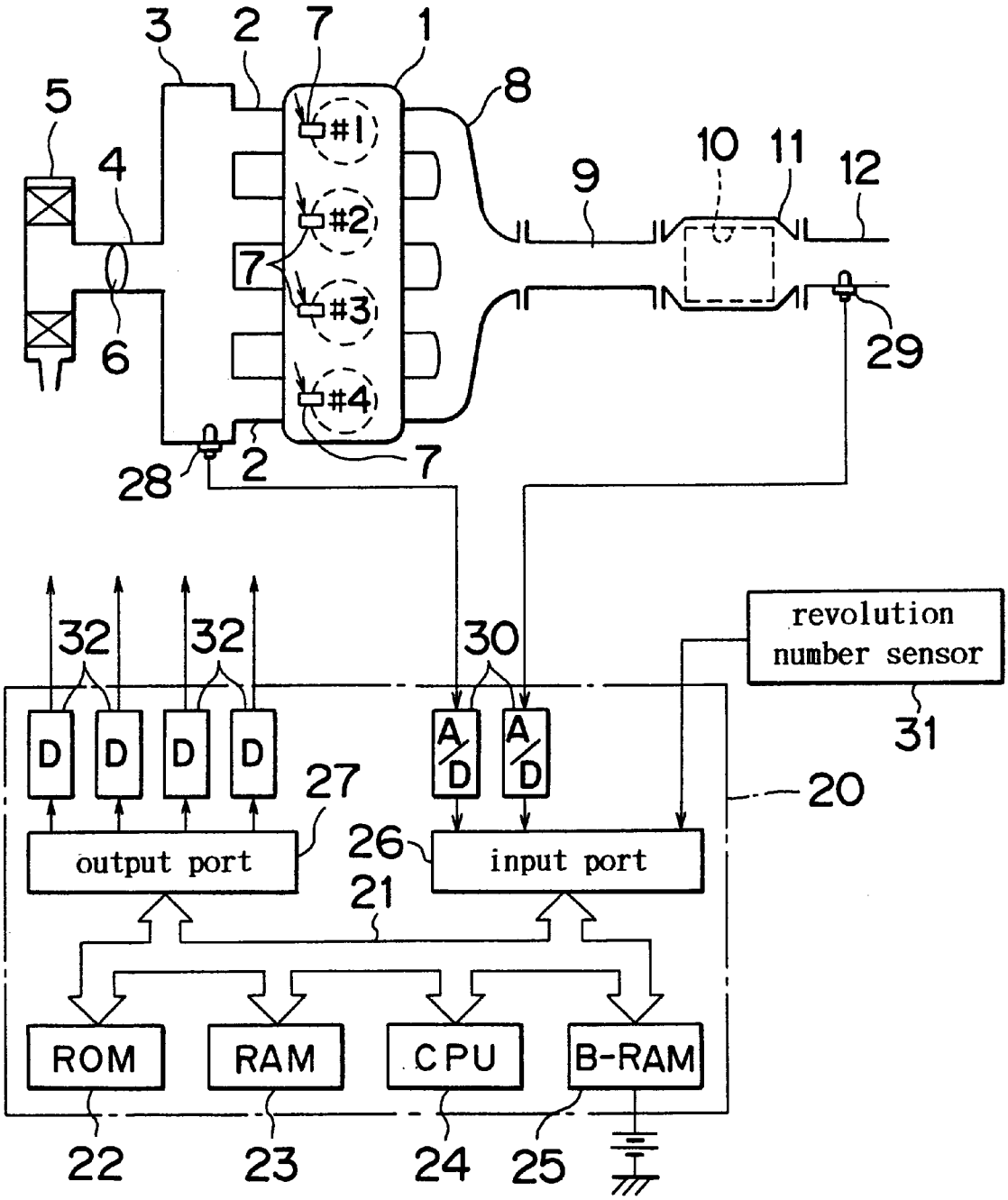
FIG. 1 is an overall view showing an internal combustion engine in a first embodiment according to the present invention.

FIG. 1 shows a first embodiment of the present invention in which the present invention is applied to a spark ignition engine.

Referring to FIG. 1, an engine main body 1 includes, for example, four cylinders. Each of the cylinders is connected to a surge tank 3 through a corresponding branch pipe 2 and the surge tank 3 is connected to an air cleaner 5 through an intake duct 4. A throttle valve 6 is provided in the intake duct 4. Also, a fuel injection valve 7 is provided in each cylinder for directly injecting fuel into the cylinder. Each cylinder is connected to a catalytic converter 11 provided with an $NO_x$ absorbent 10 through an exhaust gas manifold 8 and an exhaust pipe 9, and the catalytic converter 11 is connected to the exhaust pipe 12.

An electronic control unit 20 consists of a digital computer and includes an ROM (Read Only Memory) 22, an RAM (Random Access Memory) 23, a CPU (micro processor) 24, a B-RAM (backup RAM) 25 constantly supplied with power, an input port 26 and an output port 27 which are all mutually connected by a two-way bus 21. A pressure sensor 28 generating an output voltage proportional to the internal pressure of the surge tank 3 is provided in the surge tank 3. A temperature sensor 29 generating an output voltage proportional to the temperature of an exhaust gas flowing through the exhaust pipe 12 is provided in the exhaust pipe 12. The temperature sensor 29 may be provided upstream of the catalytic converter 11. The output voltages of the sensors 28 and 29 are inputted to the input port 26 through corresponding AD converters 30, respectively. The CPU 24 calculates an intake air amount Q from the output voltage of the pressure sensor 28. A revolution number sensor 31 generating an output pulse indicating the number of engine revolution is connected to the input port 26. The output port 27 is connected to the fuel injection valves 7 through corresponding drive circuits 32, respectively.

In the internal combustion engine shown in FIG. 1, the fuel injection time TAU(i) of the $i^{th}$ cylinder is calculated based on, for example, the following expression:

$$TAU(i)=TP\times K(i)$$

where TP is the basic fuel injection time and K(i) is the correction coefficient of the first cylinder. The basic fuel injection time TP indicates the fuel injection time required to control the air-fuel ratio of a mixture burned in the cylinder to the stoichiometric air-fuel ratio. The basic fuel injection time TP is obtained through experiment in advance and stored in the ROM 22 in advance in the form of the map shown in FIG. 2 as a function of engine load Q/N (intake air amount Q/engine revolution number N) and engine revolution number N.

The correction coefficient K(i) is the coefficient to control the air-fuel ratio of the gas mixture burned in the combustion chamber of the first cylinder. If K(i)=1.0, the air-fuel ratio of the gas mixture burned in the combustion chamber of the first cylinder becomes a stoichiometric air-fuel ratio. If K(i)<1.0, the air-fuel ratio of the gas mixture burned in the combustion chamber of the first cylinder becomes higher than the stoichiometric air fuel ratio, i.e., it becomes lean. If K(i)>1.0, the air-fuel ratio of the gas mixture burned in the combustion chamber of the first cylinder becomes lower than the stoichiometric air fuel ratio, i.e., it becomes rich.

In the internal combustion engine shown in FIG. 1, the correction coefficient K(i) is normally kept to, for example, K(i)=KL (<1.0), that is, the air-fuel ratios of gas mixtures burned in the combustion chambers of all cylinders are kept lean. Normally, therefore, lean gas mixtures are burned in all of the cylinders in the internal combustion engine of FIG. 1.

The $NO_x$ absorbent 10 contains alumina as a carrier which carries at least one of metal selected from the group consisting of alkali metal such as potassium K, sodium Na, lithium Li and cesium Cs and alkali-earth metal such as barium Ba and calcium Ca, rare earth metal such as lanthanum La and yttrium Y, as well as noble metal such as platinum Pt, palladium Pd, rhodium Rh and iridium Ir. The $NO_x$ absorbent 10 carries out the action of absorbing/discharging $NO_x$ or $SO_x$, that is, it absorbs $NO_x$ or $SO_x$ when the air-fuel ratio of an inflowing exhaust gas is lean and discharges $NO_x$ or $SO_x$ when the oxygen concentration of the inflowing exhaust gas decreases. If no fuel or air is supplied into the exhaust passage upstream of the $NO_x$ absorbent 10, the air-fuel ratio of the exhaust gas flowing into the $NO_x$ absorbent 10 is consistent to the ratio of a total air amount to the total fuel amount supplied into the combustion chambers of the respective cylinders.

If the $NO_x$ absorbent 10 stated above is disposed in the exhaust passage of the engine, the $NO_x$ absorbent 10 actually performs the action of absorbing and discharging $NO_x$ or $SO_x$. The detailed mechanism of this absorbing/discharging action is not fully known yet. It is considered, however, that the absorbing/discharging action is performed in the mechanism shown in FIGS. 3A and 3B. Next, the description of the mechanism will be explained taking an example of carrying platinum Pt and barium Ba on the carrier. The same mechanism derived from the above case can be realized by using other noble metal, alkali metal, alkali-earth metal and rare earth metal.

Figure 3A:
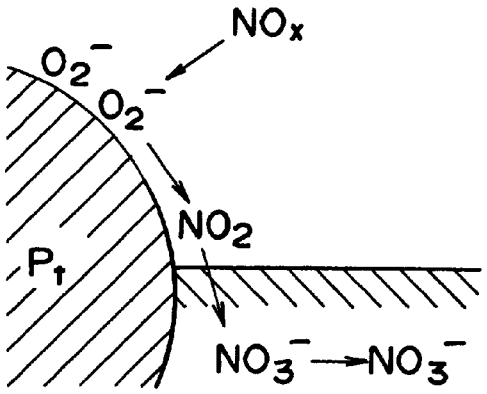
FIGS. 3A and 3B are views for explaining the $NO_x$ absorbing and discharging action of an $NO_x$ absorbent.

Namely, if the inflowing exhaust gas is considerably lean, the oxygen concentration of the inflowing exhaust gas increases greatly. As shown in FIG. 3A, oxygen molecules $O_2$ are adhered onto the surface of platinum Pt in the form of $O_2^-$ or $O^{2-}$. On the other hand, NO and $SO_2$ existing in the inflowing exhaust gas react with $O_2^-$ or $O^{2-}$ to generate $NO_2$ and $SO_3$, respectively ($2NO+O_2 2NO_2$, $2SO_2+O_2 2SO_3$). Then, the thus generated $NO_2$ and $SO_3$ are partially oxidized on platinum Pt, absorbed in the absorbent, combined with barium oxide BaO, and diffused into the absorbent as nitrate ions $NO_3^-$ or sulfate ions $SO_4^{2-}$. Thus, $NO_x$ or $SO_x$ is absorbed into the $NO_x$ absorbent 10.

As long as the oxygen concentration of the inflowing exhaust gas is high, $NO_2$ or $SO_3$ is generated on the surface of platinum Pt. As long as the $NO_x$ absorbing ability of the absorbent is not saturated, $NO_2$ or $SO_3$ is absorbed into the absorbent and nitrate ions $NO_3^-$ or sulfate ions $SO_4^{2-}$ are generated. If the oxygen concentration of the inflowing exhaust gas decreases and the amount of $NO_2$ or $SO_2$ generated decreases, inverse reaction occurs ($NO_3^-$ $NO_2$, $SO_4^{2-}$ $SO_3$), with the result that nitrate ions $NO_3^-$ or sulfate ions $SO_4^{2-}$ within the absorbent are discharged as $NO_2$ or $SO_3$, respectively. In other words, if the oxygen concentration of the inflowing exhaust gas decreases, $NO_x$ or $SO_x$ is discharged from the $NO_x$ absorbent 10. If the inflowing exhaust gas becomes less lean, the oxygen concentration of the inflowing exhaust gas decreases. Thus, if the degree of the leanness of the inflowing exhaust gas is lowered, $NO_x$ or $SO_x$ is discharged from the $NO_x$ absorbent 10.

Figure 3B:
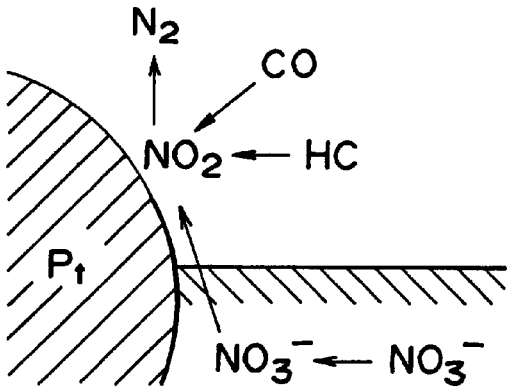

On the other hand, if the air-fuel ratio of the inflowing exhaust gas at this moment is made rich, a large amount of unburned HC and CO are discharged, react with oxygen $O_2^-$ or $O^{2-}$ on platinum Pt and oxidized. If the air-fuel ratio of the inflowing exhaust gas is made rich, the oxygen concentration of the inflowing exhaust gas extremely decreases. Therefore, $NO_2$ or $SO_3$ is discharged from the absorbent, reacts with unburned HC and CO and then reduced, as shown in FIG. 3B. Thus, if $NO_2$ or $SO_3$ does not exist on the platinum Pt surface, $NO_2$ or $SO_3$ is discharged from the absorbent one after another. Consequently, if the air-fuel ratio of the inflowing exhaust gas is made rich, $NO_x$ or $SO_x$ is discharged from the $NO_x$ absorbent 10 within a short time.

As stated above, the lean gas mixture is normally burned in all of the cylinders within the internal combustion engine. Due to this, the air-fuel ratio of the exhaust gas flowing into the $NO_x$ absorbent 10 is normally lean and $NO_x$ and $SO_x$ within the exhaust gas are, therefore, absorbed by the $NO_x$ absorbent 10. Nevertheless, as the $NO_x$ absorbent 10 has the limited $NO_x$ and $SO_x$ absorbing ability, it is required that $NO_x$ or $SO_x$ is discharged from the $NO_x$ absorbent 10 before the $NO_x$ and $SO_x$ absorbing ability thereof is saturated. In the internal combustion engine shown in FIG. 1, therefore, if the amount of $NO_x$ or $SO_x$ in the $NO_x$ absorbent 10 exceeds a predetermined amount, the air-fuel ratios of the gas mixtures burned in the respective cylinders are temporarily made rich to discharge and reduce $NO_x$ or $SO_x$ from the $NO_x$ absorbent 10. That is, if $NO_x$ or $SO_x$ is discharged from the $NO_x$ absorbent 10, the correction coefficient K(i) is set to K(i)=KR (>1.0) for all of the cylinders.

In the above case, it is considered that the good purification of $NO_x$ or $SO_x$ in the $NO_x$ absorbent 10 might not be able to be realized in the presence of oxygen in the $NO_x$ absorbent 10. The inventor of the present invention, however, confirmed that $NO_x$ or $SO_x$ can be well purified in the $NO_x$ absorbent 10 if a certain amount of oxygen exists in the $NO_x$ absorbent 10.

It has not been clarified why $NO_x$ or $SO_x$ is well purified in the presence of oxygen in the $NO_x$ absorbent 10 while the air-fuel ratio of the exhaust gas flowing into the $NO_x$ absorbent 10 is rich. The reasons might be as follows. Even if the air-fuel ratios of the gas mixtures burned in the respective cylinders are lean in the normal operation, the exhaust gases discharged from the cylinders contain HC. Some of HC is oxidized in the $NO_x$ absorbent 10 and the remaining HC is adhered onto the surface of catalyst particulates, such as platinum Pt particles without being oxidized. Also, if $NO_x$ or $SO_x$ is discharged from the $NO_x$ absorbent 10, the air-fuel ratio of the exhaust gas flowing into the $NO_x$ absorbent 10 is made rich as sated above. Owing to this, a large amount of HC and CO flow into the $NO_x$ absorbent 10 and part of HC and CO are adhered onto the platinum Pt surface. If the air-fuel ratio of the exhaust gas flowing into the $NO_x$ absorbent 10 is lean while HC and CO on the platinum Pt surface increases in amount and cover the surface of platinum Pt, oxygen $O_2$ cannot be adhered onto the platinum Pt surface in the form of $O_2^-$ or $O^{2-}$. Owing to this, $NO_x$ is less absorbed by the $NO_x$ absorbent 10, with the result that a large amount of $NO_x$ is discharged from the $NO_x$ absorbent 10. If the air-fuel ratio of the exhaust gas flowing into the $NO_x$ absorbent 10 is rich, $NO_x$ or $SO_x$, which has been discharged from the $NO_x$ absorbent, on the platinum Pt surface react less with HC and CO in the exhaust gas. As a result, a large amount of $NO_x$ or $SO_x$ is discharged from the $NO_x$ absorbent 10 as well.

Meanwhile, if oxygen exists in the $NO_x$ absorbent 10 while the air-fuel ratio of the gas mixture burned in each of the cylinders to discharge $NO_x$ or $SO_x$ from the $NO_x$ absorbent 10 is set at a stoichiometric air fuel ratio, oxidization reaction locally occurs around platinum Pt. At this moment, since the temperature of the exhaust gas flowing into the $NO_x$ absorbent 10 is increased in comparison with that in normal operation, the temperature of $NO_x$ absorbent 10 rises accordingly, with the result that HC and CO on the platinum Pt surface are further oxidized with oxygen. HC and CO are, thereby, removed from the platinum Pt surface, ensuring good $NO_x$ or $SO_x$ purification action of the $NO_x$ absorbent 10. Alternatively, if the air-fuel ratios of the gas mixtures burned in the respective cylinders are made rich, HC and CO in the exhaust gas flowing into the $NO_x$ absorbent 10 react with oxygen on the surface of, for example platinum. As a result, the surrounding of the platinum Pt is locally heated to accelerate the reaction of HC and CO adhered onto the platinum Pt surface with oxygen, thereby removing HC and CO from the platinum Pt surface. In either case, if HC is removed from the platinum Pt surface, it is reformed to a reducing agent effective for $NO_x$ or $SO_x$. This makes it possible to further ensure that $NO_x$ or $SO_x$ discharged from the $NO_x$ absorbent 10 is reduced by the reducing agent.

However, if the oxygen concentration of the $NO_x$ absorbent 10 is excessively high, HC and CO on the platinum Pt surface ior those in the inflowing exhaust gas excessively react with oxygen. As a result, the temperature of the catalytic converter 11 may possibly become excessively high to melt and damage the catalytic converter 11. For that reason, in order to well purify $NO_x$ or $SO_x$ in the $NO_x$ absorbent 10, it is necessary to keep the amount of oxygen within the $NO_x$ absorbent 10 to fall within a predetermined range, i.e., within the range in which HC and CO can be well removed from the platinum Pt surface without melting and damaging the $NO_x$ absorbent 10.

Taking the above into consideration, in this embodiment, the air-fuel ratio of the gas mixture burned in each of the cylinders, i.e., the coefficient KR is controlled such that the oxygen concentration of the exhaust gas flowing into the $NO_x$ absorbent 10 is kept in the predetermined range when $NO_x$ or $SO_x$ is to be discharged from the $NO_x$ absorbent 10.

The predetermined range in the spark ignition gasoline engine as in this embodiment ranges from, for example, about 0.3% to about 1.0%. The predetermined range in a diesel engine ranges from, for example, about 1.0% to about 2.0%. The present range for the diesel engine is higher than that for the gasoline engine because the temperature of the exhaust gas in the diesel engine is lower than that in the gasoline engine and the catalytic converter 11 is, thus, less molten and damaged, and also because the fuel of the diesel engine, i.e., light oil, has lower activity than that of gasoline and it requires relatively larger amount of oxygen than gasoline.

Figure 4A:
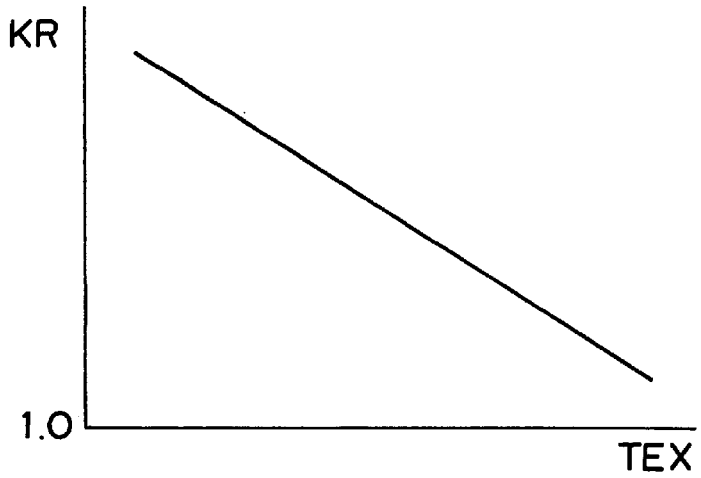
FIGS. 4A, 4B and 4C show maps of the coefficient KR.
Figure 4B:
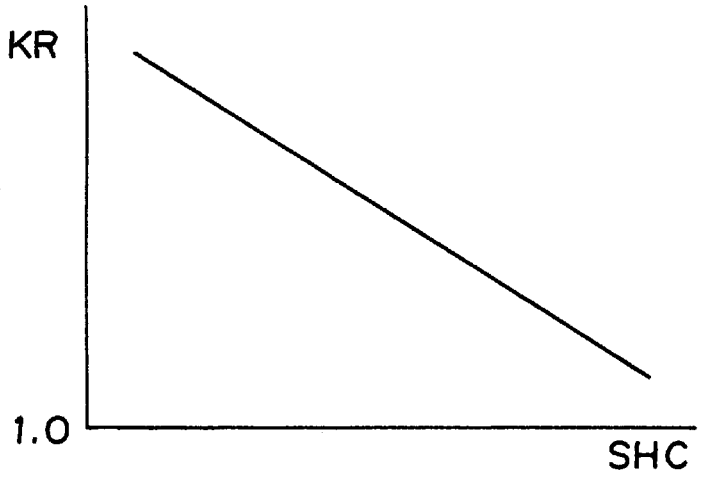

If the temperature of the $NO_x$ absorbent 10 is high, HC and CO on the platinum Pt surface react with oxygen more actively. Therefore, if a large amount of oxygen is supplied to the $NO_x$ absorbent 10 while the temperature of the $NO_x$ absorbent 10 is high, HC and COon the platinum Pt surface can be better removed. On the other hand, even if a large amount of oxygen is supplied to the $NO_x$ absorbent 10 while the temperature thereof of is low, the oxygen cannot be effectively used to remove HC and CO. Rather, the temperature of the $NO_x$ absorbent 10 decreases or the action of discharging or reducing $NO_x$ or $SO_x$ from the $NO_x$ absorbent 10 is prevented. The temperature TEX of the exhaust gas discharged from the $NO_x$ absorbent 10 detected by the temperature sensor 29 indicates the temperature of the $NO_x$ absorbent 10. It is, of course, possible to provide a temperature sensor for directly detecting the temperature of the $NO_x$ absorbent 10. In this embodiment, the coefficient KR is set such that KR becomes lower as the exhaust gas temperature TEX becomes higher as shown in FIG. 4A and that the oxygen concentration of the exhaust gas flowing into the $NO_x$ absorbent 10 becomes higher as TEX becomes higher.

In addition, as the amount of HC adhered onto the platinum Pt surface of the $NO_x$ absorbent 10 increases, a larger amount of oxygen is required to remove HC. In this embodiment, therefore, the amount SHC of HC adhered onto the $NO_x$ absorbent 10 is obtained and the coefficient KR is set such that KR becomes lower as the amount SHC of adhered HC becomes larger and that the oxygen concentration of the exhaust gas flowing into the $NO_x$ absorbent 10 increases as the amount SHC of HC adhered becomes larger. It is noted that the coefficient KR is stored in the ROM 22 in the form of a map shown in FIG. 4C.

Figure 5:
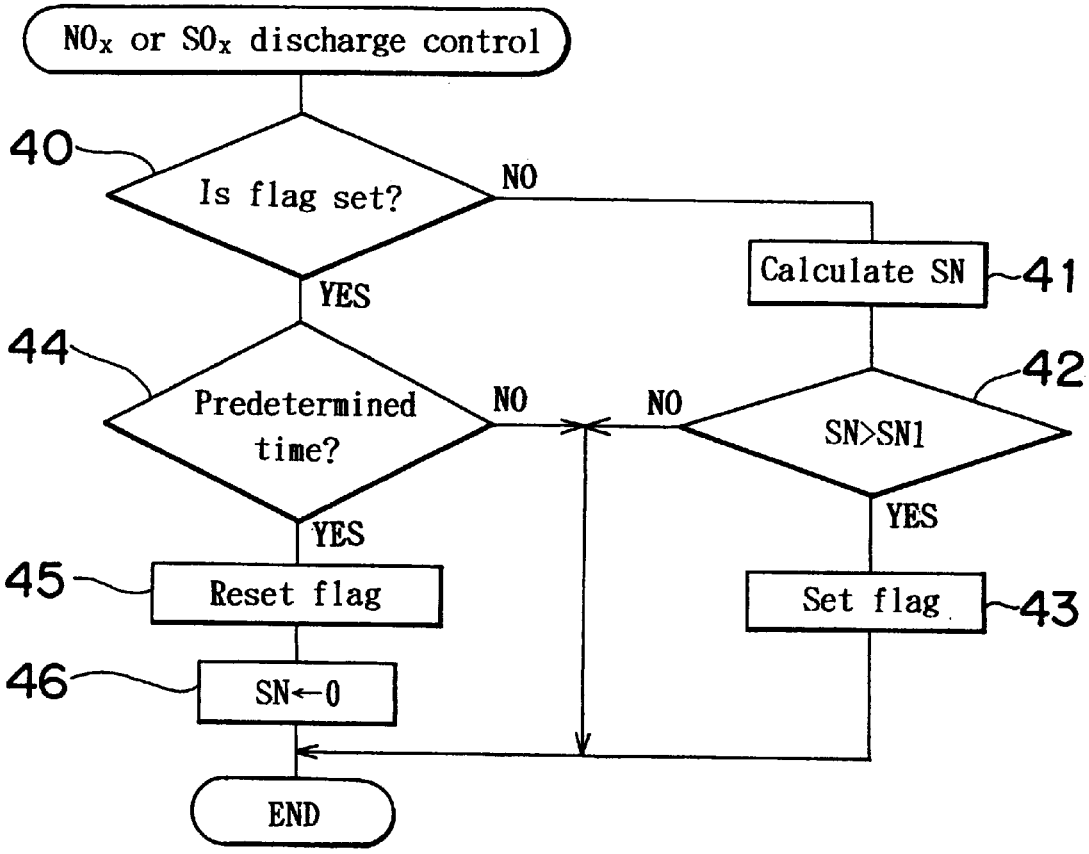
FIG. 5 is a flow chart showing an $NO_x$ or $SO_x$ discharge control routine.

FIG. 5 shows an $NO_x$ discharge control routine in this embodiment. This routine is executed by interruptions at predetermined time intervals.

Referring to FIG. 5, in step 40, the routine is set at a time when $NO_x$ or $SO_x$ is to be discharged from the $NO_x$ absorbent 10 and, otherwise, it is determined whether or not a flag to be reset is set. If the flag is reset, the process goes to step 41 where the amount SN of $NO_x$ or $SO_x$ absorbed by the $NO_x$ absorbent 10 is calculated based on an engine operating state. For instance, the amount SN of $NO_x$ or $SO_x$ flowing into the $NO_x$ absorbent 10 increases as the engine load Q/N (intake air amount Q/engine revolution number N) increases and the engine revolution number N increases. Therefore, it is possible to estimate the amount SN of the $NO_x$ or $SO_x$ absorbed based on the integrated value Q/N×N of the engine load Q/N and the engine revolution number N. In step 42, it is determined whether or not the amount SN of absorbed $NO_x$ or $SO_x$ is larger than a certain value SN1. The value SN1 is about 30% of the maximum amount of $NO_x$ or $SO_x$ absorbed by the $NO_x$ absorbent 10. If SN≦SN1, the processing cycle is ended. If SN>SN1, the process goes to the next step 43 where the flag is set.

When the flag is set, the process goes from step 40 to step 44. In step 44, it is determined whether or not a predetermined or more time has elapsed since the flat was set, i.e., whether or not the $NO_x$ absorbent 10 has performed the $NO_x$ or $SO_x$ discharging action for a predetermined or more time. If a predetermined or more time has not elapsed since the flag was set, the processing cycle is ended. If a predetermined or more time has elapsed since the flag was set, the process goes to the next step 45 where the flag is reset. In the following step 46, the amount SN of absorbed $NO_x$ or $SO_x$ is cleared (SN=0).

Figure 6:
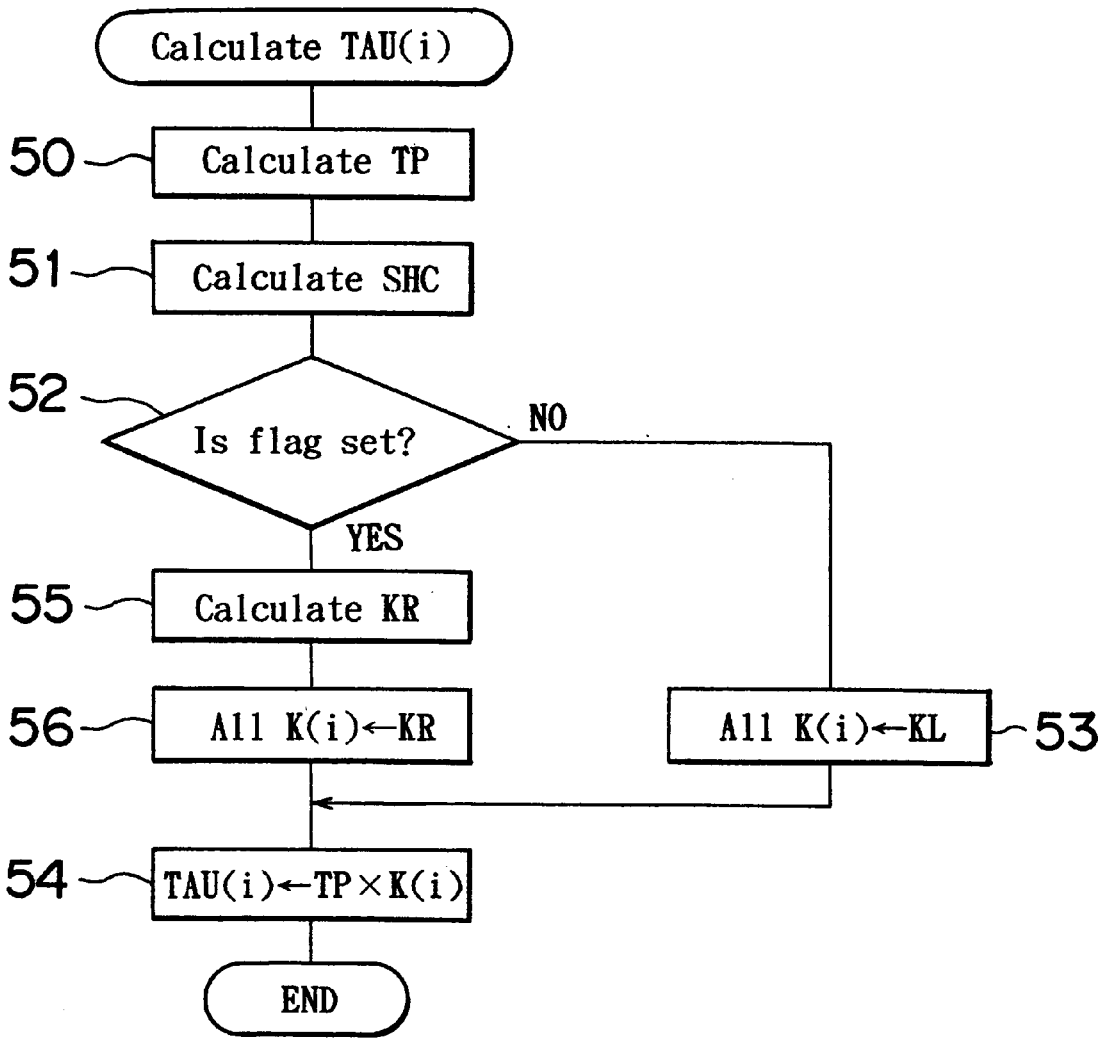
FIG. 6 is a flow chart for calculating the fuel injection time.

FIG. 6 shows a routine for calculating a fuel injection time TAU(i) for each of the cylinders. This routine is executed by interruptions at predetermined time intervals.

Figure 2:
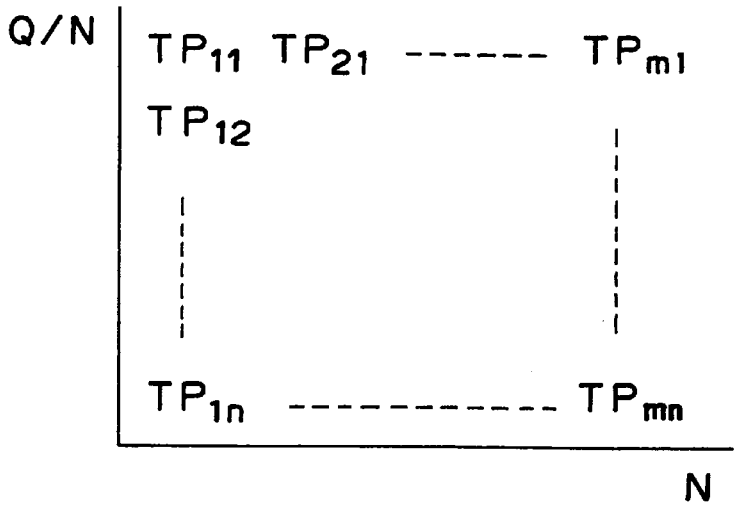
FIG. 2 shows a map for the basic fuel injection time.

Referring to FIG. 6, a basic fuel injection time TP is calculated from the map of FIG. 2 in step 50. In the next step 51, the amount SHC of HC adhered onto the $NO_x$ absorbent 10 is calculated. For instance, if the amount of fuel supplied to the engine 1 increases, the amount SHC of adhered HC increases. It is, therefore, possible to estimate the amount SHC of adhered HC based on the integrated value of the fuel injection times TAU(i) for each of the cylinders. In the next step 52, it is determined whether or not a flag is set. If the flag is reset, i.e., $NO_x$ or $SO_x$ should not be discharged from the $NO_x$ absorbent 10, the process goes to the next step 53 where correction coefficients K(i) for all cylinders are set at KL, e.g., 0.6. In the following step 54, the fuel injection time TAU(i) is calculated (TAU(i)=TP×K(i)).

Figure 4C:
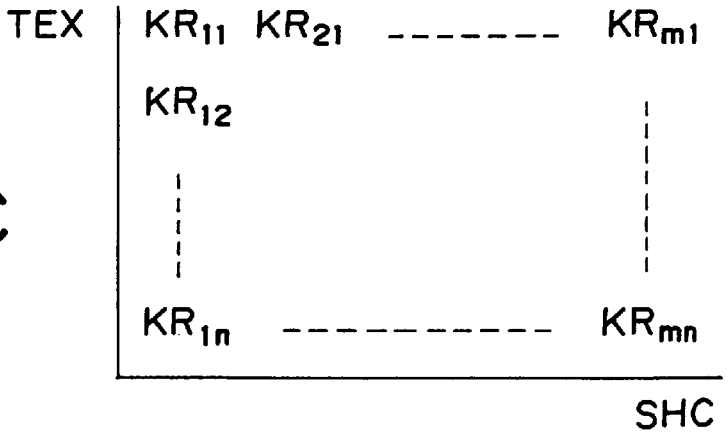

On the other hand, if the flag is set, the process goes from step 52 to step 55, where the coefficient KR is calculated from the map of FIG. 4C. In the next step 56, correction coefficients K(i) for all of the cylinders are set at KR. In the next step 54, the fuel injection time TAU(i) is calculated.

A second embodiment according to the present invention will be described hereinafter.

In the second embodiment, as in the first embodiment, the correction coefficient K(i) is set at K(i)=KL (<1.0) for each of the cylinders in normal operation and the air-fuel ratio of the exhaust gas flowing into the $NO_x$ absorbent 10 is made lean. If $NO_x$ or $SO_x$ is to be discharged from the $NO_x$ absorbent 10, the air-fuel ratio of the exhaust gas flowing into the $NO_x$ absorbent 10 is made rich. In this embodiment, however, the air-fuel ratios of the exhaust gases discharged from some cylinders are made rich and those from the other cylinders are made lean. By doing so, the air-fuel ratio of the gas mixture flowing into the $NO_x$ absorbent 10 is made rich and, at the same time, oxygen at a concentration within the predetermined range is contained in the exhaust gas flowing into the $NO_x$ absorbent 10.

Figure 7A:
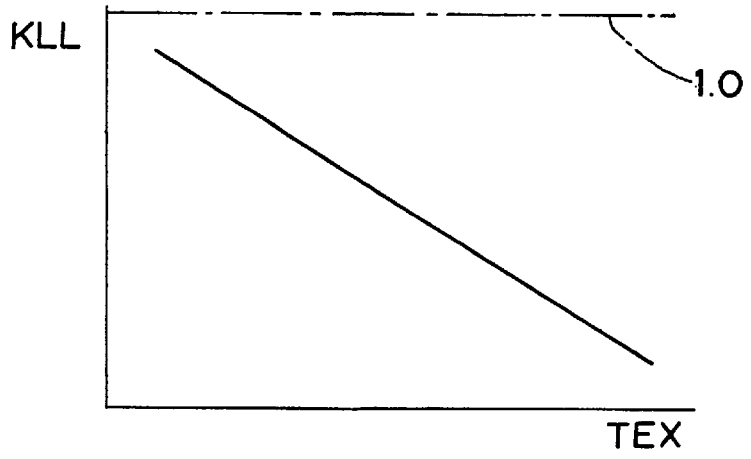
FIGS. 7A, 7B and 7C show maps of a coefficient KLL.
Figure 7B:
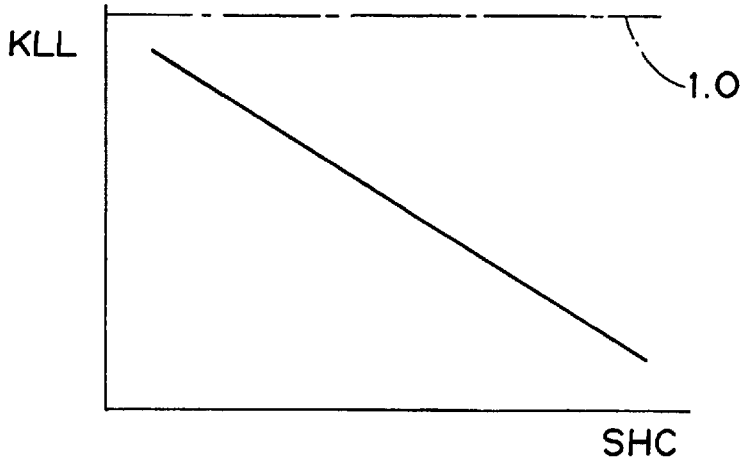

Specifically, in this embodiment, the air-fuel ratios of the gas mixtures burned in the first, second and third cylinders are set rich, whereas the air-fuel ratio of the gas mixture burned in the fourth cylinder is set lean. By doing so, the air-fuel ratio of the gas mixture flowing into the $NO_x$ absorbent 10 is made rich and the exhaust gas flowing into the $NO_x$ absorbent 10 contains oxygen at a concentration which falls within the above predetermined range. In this case, the correction coefficients K(1), K(2) and K(3) for the first, second and third cylinders, respectively, are set at a certain coefficient KRR (>1.0) and the correction coefficient K(4) for the fourth cylinder is set at a coefficient KLL (<1.0). The coefficient KLL is controlled in accordance with the temperature of the $NO_x$ absorbent 10 and with the amount of HC adhered onto the $NO_x$ absorbent 10. That is, as shown in FIG. 7A, the coefficient KLL is set to be lower as the exhaust gas temperature TEX is higher, whereby the oxygen concentration of the exhaust gas flowing into the $NO_x$ absorbent 10 becomes higher as the increase in the exhaust gas temperature TEX. In addition, as shown in FIG. 7B, the coefficient KLL is set to be lower as the amount SHC of HC adhered is larger, whereby the oxygen concentration of the exhaust gas flowing into the $NO_x$ absorbent becomes high if the amount SHC of adhered HC is high. It is noted that the coefficient KLL is stored in the ROM 22 in advance in the form of the map shown in FIG. 7C.

Figure 8:
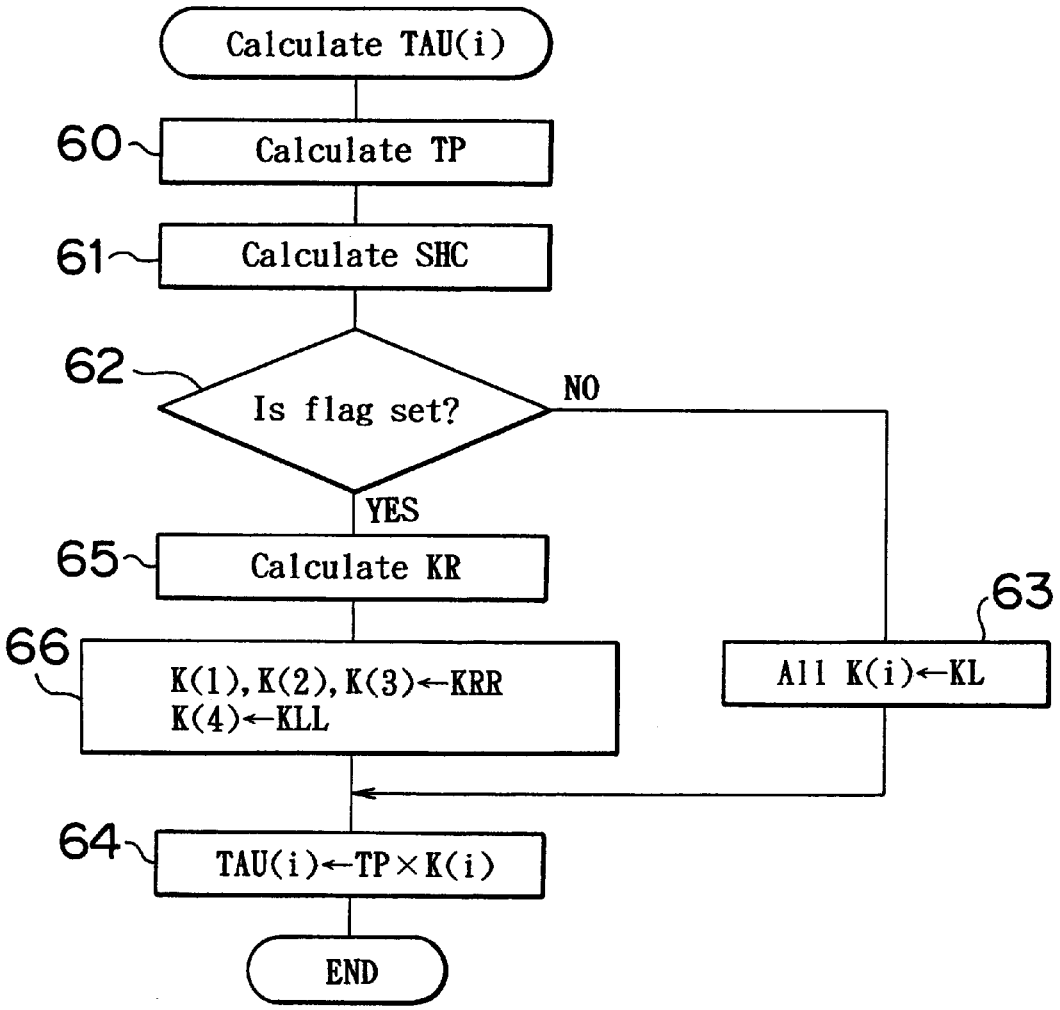
FIG. 8 is a flow chart for calculating the fuel injection time in a second embodiment according to the present invention.

FIG. 8 shows a routine for calculating a fuel injection time TAU(i) for each of the cylinders. This routine is executed by interruptions at predetermined time intervals. In this embodiment, as in the preceding embodiment, the $NO_x$ discharge control routine shown in FIG. 5 is executed.

Referring to FIG. 8, in step 60, a basic fuel injection time TP is calculated from the map of FIG. 2. In the next step 61, the amount SH of HC adhered onto the $NO_x$10 is calculated. In step 62, it is determined whether or not a flag is set. If the flag is reset, that is, if $NO_x$ or $SO_x$ should not be discharged from the $NO_x$ absorbent 10, the process goes to the next step 63 where the correction coefficient K(i) for each of the cylinders is set at KL, e.g., 0.6. In step 64, a fuel injection time TAU(i) is calculated (TAU(i)=TP×K(i)).

Figure 7C:
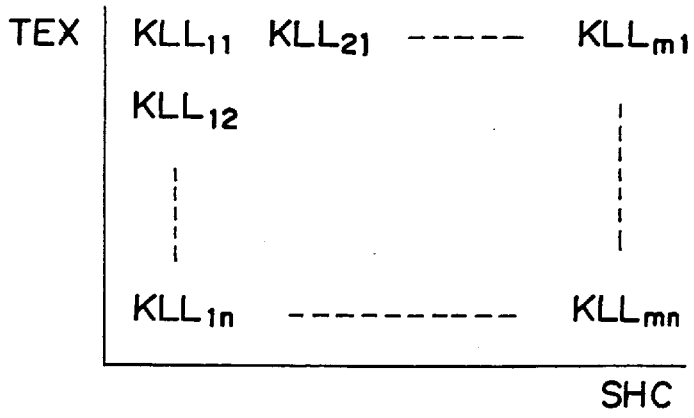

If the flag is set, the process goes from step 62 to step 65, where the coefficient KLL is calculated from the map of FIG. 7C. In the next step 66, the correction coefficients K(1), K(2) and K(3) for the first, second and third cylinders, respectively, are set at the coefficient KRR and the correction coefficient K(4) for the fourth cylinder is set at the coefficient KLL. In the next step 64, a fuel injection time TAU(i) is calculated.

Meanwhile, as already stated above, the following idea is proposed. If the air-fuel ratio of the exhaust gas flowing into the $NO_x$ absorbent 10 is made rich and the inflowing exhaust gas contains oxygen, HC and CO within the inflowing exhaust gas first react with oxygen on the surface of, for example, platinum Pt to locally heat the surrounding of, for example, platinum Pt. Thus, the reaction of HC adhered onto the platinum Pt surface with oxygen is accelerated to remove HC and CO from the platinum Pt surface. Based on this idea, it is possible to well remove HC and CO adhered onto the $NO_x$ absorbent 10 by increasing the oxygen concentration of the inflowing exhaust gas if the concentration of the reducing agent (HC, CO) within the exhaust gas flowing into the $NO_x$ absorbent 10 is high.

Meanwhile, the concentration of the reducing agent (HC, CO) in the exhaust gas flowing into the $NO_x$ absorbent 10 is proportional to the air-fuel ratio of the inflowing exhaust gas. That is, in the embodiment described with reference to FIGS. 7 and 8, it depends on the coefficient KRR for the cylinder in which the rich gas mixture is burned. Therefore, the coefficient KLL for the cylinder, in which the lean gas mixture is burned, may be set to be lower as the coefficient KRR is higher.

In addition, even if the air-fuel ratio of the exhaust gas is the same, combustion system, the volume of the cylinder and the like differ, depending on the internal combustion engines, and the concentration of the reducing agent in the exhaust gas discharged from the cylinder, therefore, differs, depending on the internal combustion engines. Considering the difference, it is also possible to obtain the concentration of a reducing agent in the exhaust gas discharged from the cylinder for every internal combustion engine in advance and to set the oxygen concentration of the exhaust gas flowing into the $NO_x$ absorbent 10 in accordance with the concentration of the reducing agent.

Figure 9:
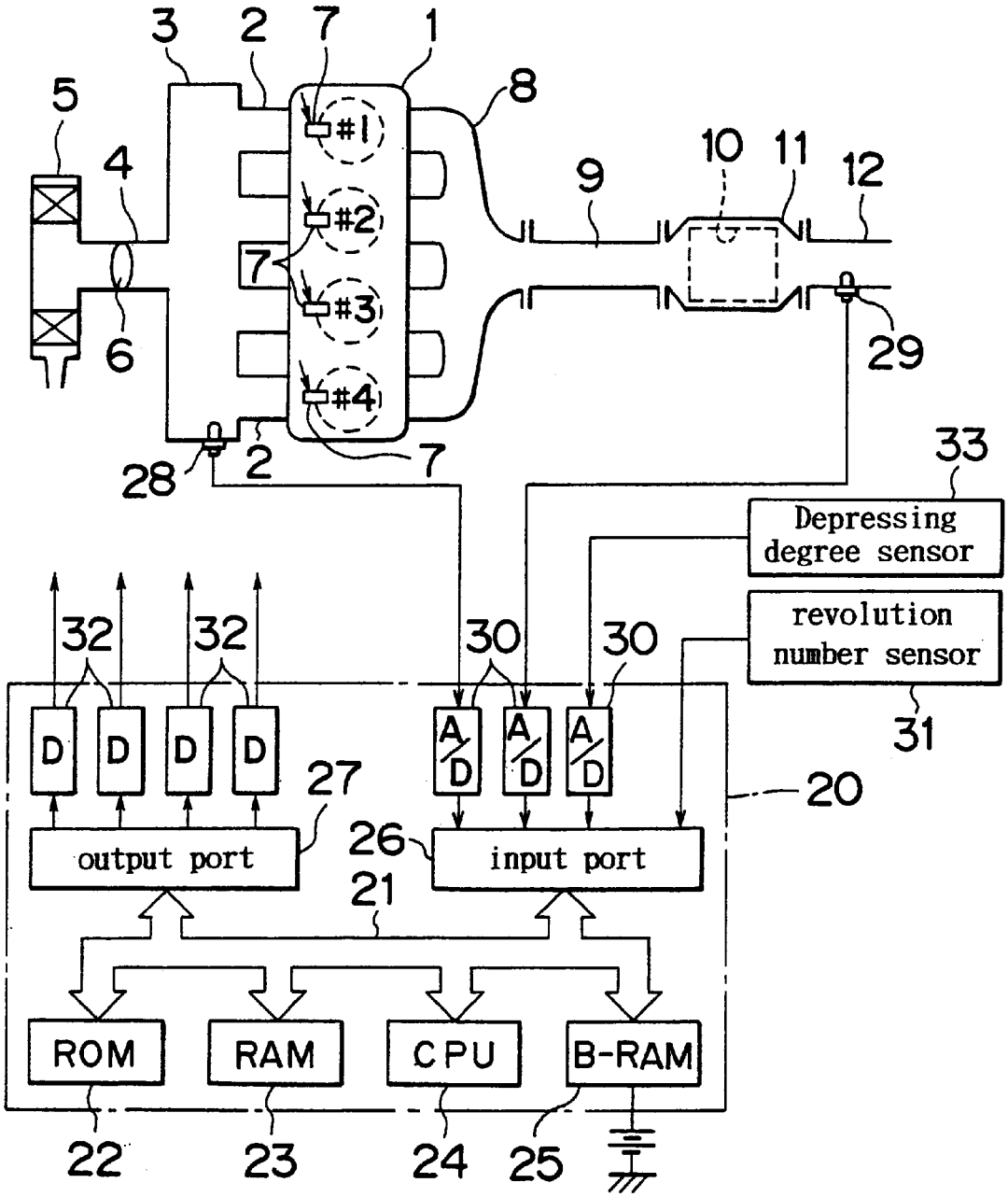
FIG. 9 is an overall view showing an internal combustion engine in a third embodiment according to the present invention.

FIG. 9 shows a third embodiment in which the present invention is applied to a diesel engine. Referring to FIG. 9, a depressing sensor 33 generating an output voltage proportional to the depressing degree of an accelerator pedal (not shown), is connected to an input port 26 of an electronic control unit 20 through a corresponding AD converter 30.

Figure 10:
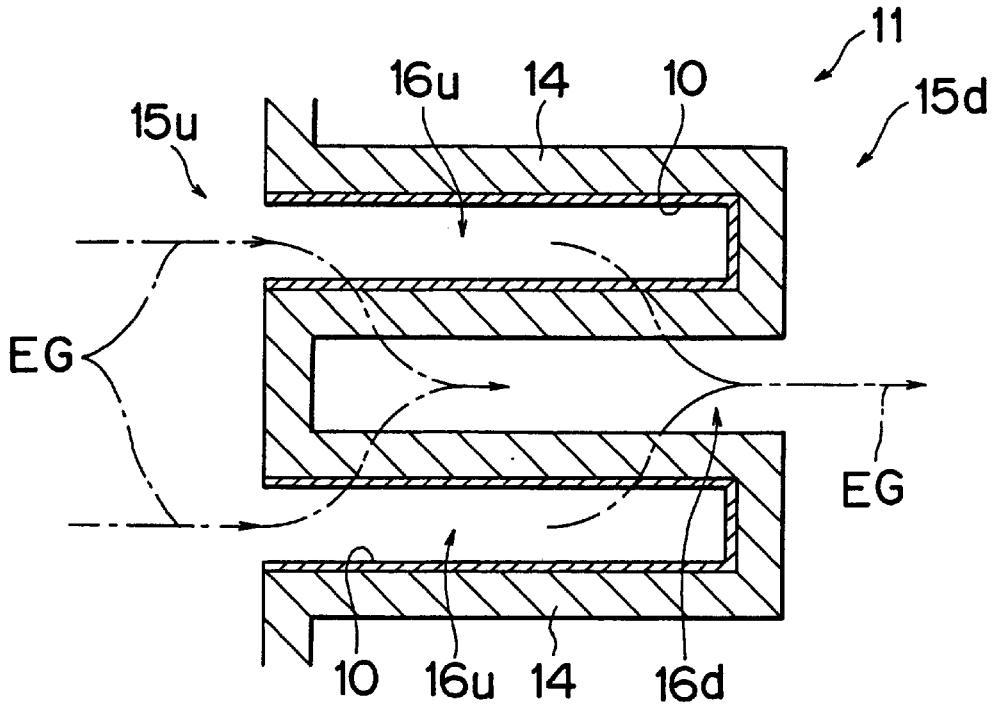
FIG. 10 is a partially enlarged cross-sectional view of a catalytic converter.

FIG. 10 is a partially enlarged cross-sectional view of the catalytic converter 11. Referring to FIG. 10, the catalytic converter 11 of wall-flow type includes a plurality of cells determined by a cell wall 14 formed of porous material such as ceramic and extending almost parallel to the axis of the exhaust passage. In the converter 11, upstream end opening cells **16*u* each having an exhaust upstream end 15*u* opened and an exhaust downstream end 15*d* closed, and downstream end opening cells 16*d* each having an exhaust upstream end 15*u* closed and the exhaust downstream end 15*d* opened, are arranged alternately. An $NO_x$ absorbent 10 is provided on the inner wall surfaces of the upstream end opening cells 16*u*, while no $NO_x$ absorbent 10 is arranged on the inner wall surfaces of the downstream end opening cells 16*d*. Therefore, as indicated by an arrow EG in FIG. 10, the exhaust gas flowing into the catalytic converter 11 first flows into the upper end opening cells 16*u*, sequentially passes through the $NO_x$ absorbent 10 and the cell wall 14, flows into the downstream end opening cells 16*d* and then flows out of the catalytic converter 11**.

In the diesel engine, a gas mixture is normally burned in an excessive air state, so that the air-fuel ratio of the exhaust gas flowing into the $NO_x$ absorbent 10 is usually kept lean and, at this time, $NO_x$ or $SO_x$ is, therefore, absorbed into the $NO_x$ absorbent 10. If the amount of $NO_x$ or $SO_x$ absorbed into the $NO_x$ absorbent is larger than a predetermined amount, the air-fuel ratio of the exhaust gas discharged from the engine 1 is temporarily made rich, whereby $NO_x$ or $SO_x$ absorbed into the $NO_x$ absorbent 10 is discharged and reduced.

Figure 11:
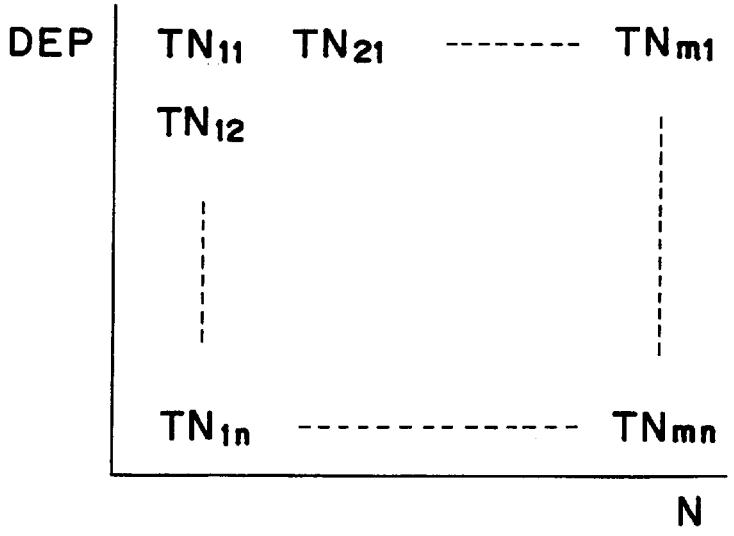
FIG. 11 shows a map of the secondary fuel injection time TN.

In this embodiment, in order to make the air-fuel ratio of the exhaust gas discharged from the engine 1 rich, the second fuel injection, i.e., secondary fuel injection from a fuel injection valve 7 is conducted in an expansion stroke or an exhaust stroke, irrespective of the fuel injection conducted around a compression top deadcenter. It is noted that the fuel obtained by the secondary fuel injection hardly contributes to engine output. The secondary fuel injection time TAUS at a time of discharging $NO_x$ or $SO_x$ from the $NO_x$ absorbent 10 is set at TN and the secondary fuel injection timing FIT is set at ADV. The time TN is a fuel injection time required to obtain an optimum air-fuel ratio to discharge $NO_x$ or $SO_x$ from the $NO_x$ absorbent 10 and to reduce the discharged $NO_x$ or $SO_x$, and it is obtained through experiment in advance as a function of the accelerator pedal depressing degree and the engine revolution number N. The time TN is stored in the ROM 22 in advance in the form of the map shown in FIG. 11. The ADV is set at, for example, a crank angle (CA) of 90° to a CA of 120° with respect to the compression top dead center (ATDC).

As stated above, if the air-fuel ratio of the exhaust gas flowing into the $NO_x$ absorbent 10 is made rich and oxygen is supplied, for example, around platinum Pt, it is considered that $NO_x$ or $SO_x$ can be well purified in the $NO_x$ absorbent 10. If oxygen is contained in the exhaust gas flowing into the $NO_x$ absorbent 10, oxygen is supplied around platinum Pt but, in this case, the oxygen does not necessarily reach the surrounding of platinum Pt. Due to this, oxygen cannot be effectively utilized to remove HC and CO from the platinum Pt surface.

Meanwhile, if oxygen is supplied from the $NO_x$ absorbent 10 around platinum Pt, almost all oxygen can reach platinum Pt. In this embodiment, therefore, an oxygen occluding material which stores oxygen if the oxygen concentration in the inflowing exhaust gas increases and discharges oxygen stored if the oxygen concentration decreases, is provided in the $NO_x$ absorbent 10 around the platinum Pt. Then, if the air-fuel ratio of the exhaust gas flowing into the $NO_x$ absorbent 10 is lean, oxygen is stored in the oxygen occluding material. If the air-fuel ratio of the exhaust gas flowing into the $NO_x$ absorbent 10 is made rich so as to discharge $NO_x$ or $SO_x$ from the $NO_x$ absorbent, oxygen is supplied from the oxygen occluding material to the surrounding of the platinum Pt.

As stated above, if the temperature of the surrounding of platinum Pt increases, HC and CO oxidizing reaction and removing action are accelerated on the platinum Pt surface, or the $NO_x$ or $SO_x$ discharge action from the $NO_x$ absorbent 10 and the discharged $NO_x$ or $SO_x$ reducing reaction are accelerated. If oxygen reacts with the reducing agent such as HC on the platinum Pt surface, the temperature of the surrounding of platinum Pt increases. If oxygen is supplied around platinum Pt, the temperature of the surrounding of platinum Pt increases. On the other hand, if the air-fuel ratio of the exhaust gas flowing into the $NO_x$ absorbent 10 is rich as stated above, oxygen is supplied from the oxygen occluding material to the surrounding of platinum Pt. In this embodiment, therefore, HC is supplied to the surrounding of platinum Pt if the air-fuel ratio of the exhaust gas flowing into the $NO_x$ absorbent 10 is rich.

It is possible to utilize HC to increase the temperature of the surrounding of platinum Pt more effectively by supplying HC from the $NO_x$ absorbent 10 around platinum Pt than providing HC into the exhaust gas flowing into the $NO_x$ absorbent 10. In this embodiment, therefore, an HC absorbent, which absorbs HC when the temperature of platinum PC is high and releases absorbed HC when the temperature thereof is high, is provided in the $NO_x$ absorbent 10 and the temperature of the exhaust gas is decreased when the air-fuel ratio of the exhaust gas flowing into the $NO_x$ absorbent 10 is lean and the temperature thereof is increased when the air-fuel ratio of the exhaust gas flowing into the $NO_x$ absorbent 10 is rich. In other words, if the air-fuel ratio of the exhaust gas flowing into the $NO_x$ absorbent 10 is lean, the temperature of the HC absorbent is decreased, so that HC is absorbed by the HC absorbent. If the air-fuel ratio of the exhaust gas flowing into the $NO_x$ absorbent 10 is rich, the temperature of the HC absorbent is increased, so that HC is released from the HC absorbent and supplied to the surrounding of platinum Pt.

Figure 12A:
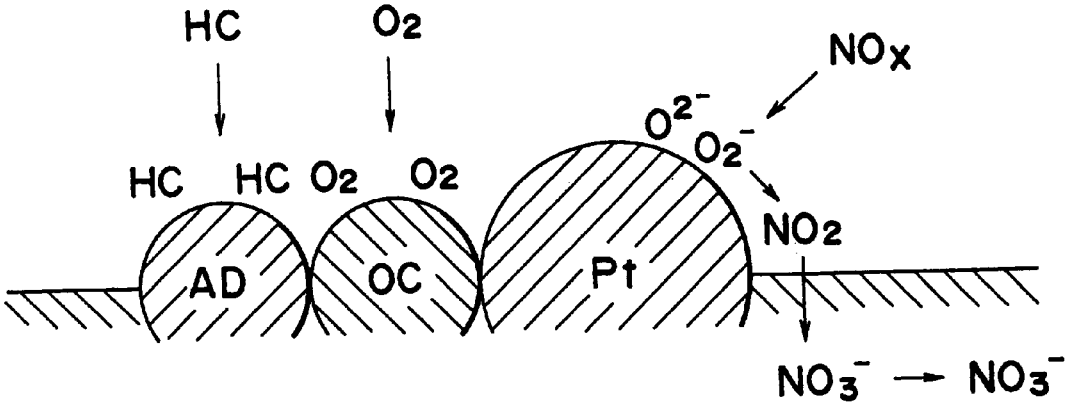
FIGS. 12A and 12B are views explaining the $NO_x$ absorbing and discharging action of the $NO_x$ absorbent, the oxygen absorbing and discharging action of an oxygen occluding material and the HC absorbing and releasing action of an HC absorbent.
Figure 12B:
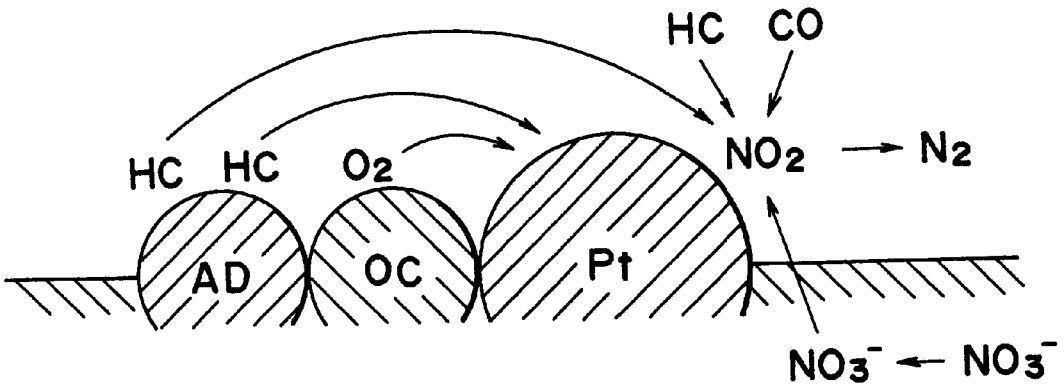

That is to say, if the air-fuel ratio of the exhaust gas flowing into the $NO_x$ absorbent 10 is lean as shown in FIG. 12A while the oxygen occluding material is denoted by OC and the HC absorbent is denoted by AD, then $NO_x$ in the exhaust gas flowing into the $NO_x$ absorbent 10 is absorbed, oxygen $O_2$ in the inflowing exhaust gas is stored in the oxygen occluding material OC and HC in the inflowing exhaust gas is absorbed by the HC absorbent AD. If the air-fuel ratio of the exhaust gas flowing into the $NO_x$ absorbent 10 is rich, by contrast, then $NO_x$ is discharged from the $NO_x$ absorbent 10, oxygen $O_2$ is discharged from the oxygen occluding material OC and HC is released from the HC absorbent as shown in FIG. 12B. Oxygen $O_2$ discharged from the oxygen occluding material OC and HC released from the HC absorbent move onto the platinum Pt surface and react thereon, thereby increasing the temperature of the surrounding of platinum Pt. Furthermore, if the HC released from the HC absorbent reacts with oxygen $O_2$, the reacted HC is improved to a reducing agent effective for $NO_x$ or $SO_x$. As a result, it is possible to well purify $NO_x$ or $SO_x$ in the $NO_x$ absorbent 10.

Ceria (cerium oxide) $CeO_2$, for instance, may be used as an oxygen occluding material and zeolite or mordenite, for instance, may be used as an HC absorbent and may be used as a carrier. In this embodiment, the $NO_x$ absorbent 10 has a carrier of, for example, zeolite or mordenite, which carries at least one metal selected from the group consisting of alkali metal such as potassium K, sodium Na, lithium Li and cesium Cs, and alkali-earth metal such as barium Ba and calcium Ca, rare earth metal such as lanthanum La and yttrium Y, as well as noble metal such as platinum Pt, palladium Pd, rhodium Rh and iridium Ir and ceria $CeO_2$.

In the diesel engine shown in FIG. 9, the HC concentration of the exhaust gas discharged during normal operation is relatively low, so that a sufficient amount of HC cannot be absorbed by the HC absorbent during normal operation. In this embodiment, therefore, secondary fuel injection is conducted during normal operation to thereby supply HC to the HC absorbent.

Figure 13:
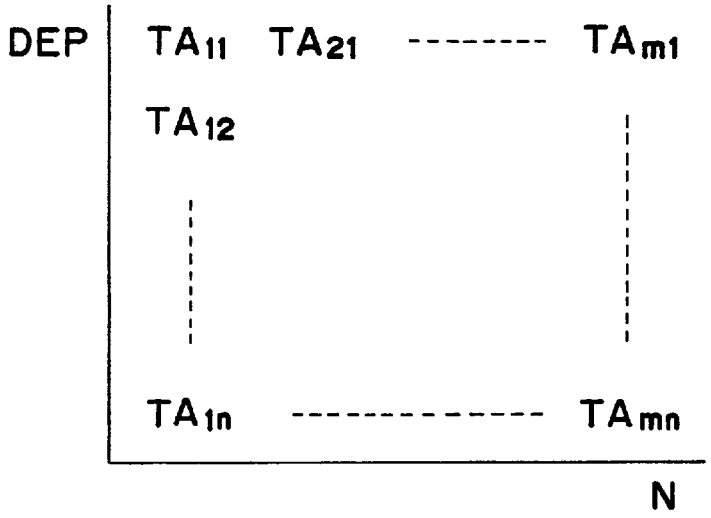
FIG. 13 shows a map of the secondary fuel injection time TA.

During normal operation, however, if the air-fuel ratio of the exhaust gas flowing into the $NO_x$ absorbent 10 is lean and secondary fuel injection is conducted to decrease the oxygen a concentration of the exhaust gas flowing into the $NO_x$ absorbent 10, then $NO_x$ or $SO_x$ is discharged from the $NO_x$ absorbent 10. In addition, if HC for the secondary fuel injection is oxidized in the $NO_x$ absorbent 10, the temperature of the HC absorbent increases and HC is released from the HC absorbent. To avoid this, the secondary fuel injection time TAUS at which HC is to be supplied to the HC absorbent is set at an injection time TA at which no $NO_x$ is discharged from the $NO_x$ absorbent 10 and no HC is released from the HC absorbent. The injection time TA is obtained in advance through experiment as a function of the accelerator pedal depressing degree DEP and the engine revolution number N and it is stored in the ROM 22 in advance in the form of the map shown in FIG. 13.

The secondary fuel injection timing FIT is set at RTD, which is set, for example, between CA of 150° and 180° of the ATDC which is delayed from ADV. If the secondary fuel injection timing is delayed, the HC ratio burned in the combustion chamber or the exhaust passage to that obtained by the secondary fuel injection is lowered, thereby maintaining the temperature of the exhaust gas flowing into the $NO_x$ absorbent 10 low. In addition, since the HC supplied to the HC absorbent is heavy HC (high monocular HC), it is difficult to oxidize in the $NO_x$ absorbent 10. It is, therefore, possible to suppress the temperature rise of the HC absorbent during normal operation and to, thereby, suppress the release of HC from the HC absorbent.

Conversely, if the secondary fuel injection timing is advanced as in the case of discharging $NO_x$ or $SO_x$ from the $NO_x$ absorbent 10, the HC ratio burned in the combustion chamber or exhaust passage increases. Due to this, the temperature of the exhaust gas flowing into the $NO_x$ absorbent 10 increases to thereby accelerate the release of HC from the HC absorbent. Since the HC supplied to the $NO_x$ absorbent at this time is light HC (low molecular HC), it tends to react in the $NO_x$ absorbent 10. It is, therefore, possible to easily reduce $NO_x$ or $SO_x$ discharged from the $NO_x$ absorbent 10. Besides, if part of HC as a result of the secondary fuel injection is burned in the combustion chamber or the exhaust passage, the oxygen in the exhaust gas discharged from the engine is consumed, making is possible to maintain the oxygen concentration of the exhaust gas flowing into the $NO_x$ absorbent 10 to fall within the predetermined range as in the case of the embodiment described with reference to FIGS. 1 to 8.

In the meantime, the wall-flow type catalytic converter 11 is employed in this embodiment, as already stated above. If using the converter 11 of this type, all of the exhaust gases flowing into the catalytic converter 11 flow through the HC absorbent. This allows the HC absorbent to absorb HC during normal operation and the oxygen occluding material to store oxygen efficiently.

Figure 14:
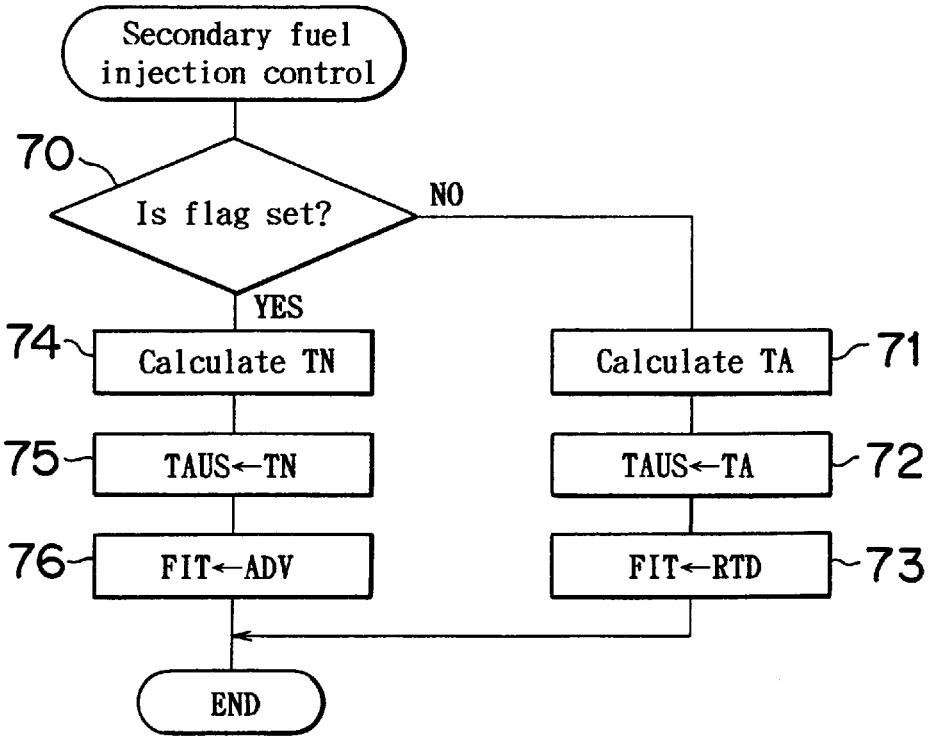
FIG. 14 is a flow chart for the secondary fuel injection control.

FIG. 14 shows the routine for secondary fuel injection control in this embodiment. This routine is executed by interruptions at predetermined crank angles. It is noted that the $NO_x$ discharge control routine shown in FIG. 5 is also executed in this embodiment.

Now referring to FIG. 14, it is first determined whether or not a flag is set in step 70. If the flag is reset, i.e., $NO_x$ or $SO_x$ should not be discharged from the $NO_x$ absorbent 10, the process goes to the next step 71 where TA is calculated from the map of FIG. 13. In step 72, the secondary fuel injection time TAUS is set at TA. In step 73, the secondary fuel injection timing FIT is set at RTD. On the other hand, if the flag is set, i.e., $NO_x$ or $SO_x$ should be discharged from the $NO_x$ absorbent 10, then the process goes from step 70 to step 74 where TN is calculated from the map of FIG. 11. In step 75, the secondary fuel injection time TAUS is set at TN. Instep 76, the secondary fuel injection timing FIT is set at ADV.

It is possible to provide an electric heater at the $NO_x$ absorbent 10 so that the electric heater can heat both the $NO_x$ absorbent 10 and the HC absorbent when the air-fuel ratio of the exhaust gas flowing into the $NO_x$ absorbent 10 is rich. It is also possible to make the air-fuel ratio of the exhaust gas flowing into the $NO_x$ absorbent 10 rich to discharge $NO_x$ or $SO_x$ from the $NO_x$ absorbent 10 since the temperature of the $NO_x$ absorbent 10 increases during engine accelerating operation or immediately thereafter.

Next, description will be given to an embodiment in which $SO_x$ absorbed is efficiently released or reduced in the occluding and reducing type $NO_x$ catalyst or the $SO_x$ absorber.

The fuel of the internal combustion engine contains sulfur. If the fuel is burned in the internal combustion engine, the sulfur contained in the fuel is burned to generate sulfur oxide ($SO_x$) The occluding and reducing type $NO_x$ catalyst absorbs $SO_x$ in the exhaust gas in the same mechanism as that of the $NO_x$ absorption action. For that reason, if the occluding and reducing type $NO_x$ catalyst is disposed in the exhaust passage of the internal combustion engine, not only $NO_x$ but also $SO_x$ are absorbed by the occluding and reducing type $NO_x$ catalyst.

The $SO_x$ absorbed by the occluding and reducing type $NO_x$ catalyst, however, forms stable sulfate with the passage of time. Due to this, the $SO_x$ tends to be less dissolved and discharged and tends to be stored in the occluding and reducing type $NO_x$ catalyst under the conditions for discharging, and reducing and purifying (to be referred to as 'regeneration' hereinafter) $NO_x$ from the normal occluding and reducing type $NO_x$ catalyst. If the stored $SO_x$ in the occluding and reducing type $NO_x$ catalyst increases in amount, the $NO_x$ absorption volume of the occluding and reducing type $NO_x$ catalyst decreases. As a result, $NO_x$ in the exhaust gas cannot be sufficiently removed and $NO_x$ purification efficiency deteriorates, thus causing so-called $SO_x$ poisoning. Taking this into consideration, it is necessary to discharge $SO_x$ absorbed by the occluding and reducing type $NO_x$ catalyst at appropriate timing so as to maintain the $NO_x$ purifying capability of the occluding and reducing type $NO_x$ catalyst high for a long time.

It is known that the air-fuel ratio of the inflowing exhaust gas is made stoichiometric or rich and the temperature of the occluding and reducing type $NO_x$ catalyst is made higher than that during normal reduction for purposes of discharging the $SO_x$ absorbed by the occluding and reducing type $NO_x$ catalyst.

Based on the above, at the predetermined timing before the $NO_x$ purifying capability of the occluding and reducing type $NO_x$ catalyst is deteriorated by $SO_x$ absorption, the exhaust gas at a stoichiometric or rich air-fuel ratio is flown to the occluding and reducing type $NO_x$ catalyst from where $SO_x$ is discharged and reduced by keeping the temperature of the catalyst high. If the exhaust gas at a stoichiometric or rich air-fuel ratio at which oxygen concentration is extremely low is supplied to the occluding and reducing type $NO_x$ catalyst, oxygen in the exhaust gas reacts with the reducing agent (HC) and burned out in an upstream portion of the occluding and reducing type $NO_x$ catalyst. At this time, the downstream region is under an non-oxygen atmosphere and only the reducing agent is supplied. Under the above atmosphere, the heavy reducing agent contained in the exhaust gas poisons the occluding and reducing type $NO_x$ catalyst to make it difficult to discharge and reduce the $SO_x$ from the occluding and reducing type $NO_x$ catalyst. Moreover, in order to discharge and reduce $SO_x$ from the occluding and reducing type $NO_x$ catalyst, it is significant to induce a reaction between the reducing agent and oxygen in the vicinity of the surface of the catalyst.

First, the mechanism of poisoning the $NO_x$ catalyst with $SO_x$ will be described. If the $SO_x$ component is contained in the exhaust gas, the $NO_x$ catalyst absorbs $SO_x$ in the exhaust gas in the same mechanism as that of $NO_x$ absorption as stated above. In other words, if the air-fuel ratio of the exhaust gas is lean, oxygen $O_2$ in the form of $O_2^-$ or $O^{2-}$ is adhered to the surface of the platinum Pt of the $NO_x$ catalyst and the $SO_x$ (such as $SO_2$) in the inflowing exhaust gas is oxidized on the platinum Pt surface into $SO_3$.

Then, the generated $SO_3$ is further oxidized on the platinum Pt surface, moved to barium oxide (BaO) and diffused in the $NO_x$ catalyst as sulfate ions $SO_4^{2-}$, thereby generating sulfate $BaSO_4$ that is likely to turn into large crystals and relatively stable. Due to this, it is difficult to dissolve and discharge the sulfate $BaSO_4$ once it is generated. As a result, if the amount of $BaSO_4$ generated in the $NO_x$ catalyst increases with the passage of time, the amount of BaO which can be involved in absorbing capability of the $NO_x$ catalyst decreases, resulting in deteriorated $NO_x$ absorbing capability. In order to maintain the $NO_x$ purifying capability of the $NO_x$ catalyst high for a long time, it is necessary to discharge $SO_x$ absorbed by the $NO_x$ catalyst at an appropriate timing.

To discharge $SO_x$ absorbed by the $NO_x$ catalyst, it is necessary to make the air-fuel ratio of the exhaust gas stoichiometric or rich, to increase the catalysis temperature of the $NO_x$ catalyst compared with that in normal regeneration in which $NO_x$ is discharged from the $NO_x$ catalyst and to realize presence of the oxygen.

To do this, therefore, if $SO_x$ is discharged from the $NO_x$ catalyst, sub-fuel injection is conducted to inject fuel into the cylinder in the expansion or discharge process of the engine 1 as in the case of $NO_x$ discharge, thereby making the air-fuel ratio of the exhaust gas flowing into the $NO_x$ catalyst 10 stoichiometric or rich.

Next, the function of the exhaust discharge control device in a fourth embodiment will be described with reference to FIG. 9. As described above, since the engine main body 1 is a diesel engine, the air-fuel ratio of the exhaust gas therein is lean and oxygen concentration is high during normal operation. Therefore, if this exhaust gas flows into the $NO_x$ catalyst 10, $NO_x$ in the exhaust gas is absorbed by the $NO_x$ catalyst 10.

As described above, if the $NO_x$ catalyst 10 absorbs $NO_x$ in the exhaust gas, it also absorbs $SO_x$ in the exhaust gas. Then, if the amount of absorbed $SO_x$ increases, the $NO_x$ absorbing capability of the $NO_x$ catalyst 10 deteriorates. As a result, even if $NO_x$ discharge processing is executed, it is impossible for the $NO_x$ absorbent to recover the initial $NO_x$ absorbing capability.

Further, as described above, it is necessary to make the catalysis temperature higher than that during $NO_x$ discharge so as to discharge $SO_x$ from the $NO_x$ catalyst 10. In the above $NO_x$ discharge processing, however, $SO_x$ cannot be discharged from the $NO_x$ catalyst 10.

In view of the above, at a predetermined timing before the $SO_x$ poisoning of the $NO_x$ catalyst 10 does not worsen(, i.e., before the $NO_x$ purification efficiency deteriorates and the $NO_x$ discharge amount increases), $SO_x$ is discharged from the $NO_x$ catalyst 10 in the catalytic converter 11. Here, the predetermined timing, at which $SO_x$ discharge processing is carried out, can be set at the timing at which the operation time of the engine 1, which is integrated by the ECU 20, reaches the predetermined time or at which the $SO_x$ absorption amount, which is estimated from the history of the operating state of the engine 1, reaches the predetermined amount.

$SO_x$ needs to be released when the catalysis temperature is high. To ensure high catalysis temperature, the EPU 20 may control $SO_x$ release processing such that the processing is executed at a timing of the acceleration operation or high load operation of the engine 1. Alternatively, the ECU 20 may control the operating state of the engine 1 so as to positively increase exhaust gas temperature during $SO_x$ discharge processing. In either case, the ECU 20 executes $SO_x$ discharge processing while the catalysis temperature of the $NO_x$ catalyst 10 falls within the range suited for $SO_x$ discharge processing.

In case of executing $SO_x$ discharge processing, the ECU 20 controls the fuel injection valve 7 to execute both main injection and sub-injection, as well as the opening timing and opening period of the fuel injection valve 7 for sub-injection, sub-injection frequency and the like.

As already described, the $SO_x$ discharge processing needs to be conducted while the catalysis temperature is higher than that in the $NO_x$ discharge processing. If the sub-injection of the fuel is conducted in the same manner as $NO_x$ discharge processing under the temperature conditions, oxygen contained in the exhaust gas is consumed while the exhaust gas flows in the upstream region of the catalytic converter 11 and no oxygen exists in the downstream region of the catalytic converter 11. Due to this, the downstream region cannot be kept under an $SO_x$ dischargeable atmosphere.

Figure 15:
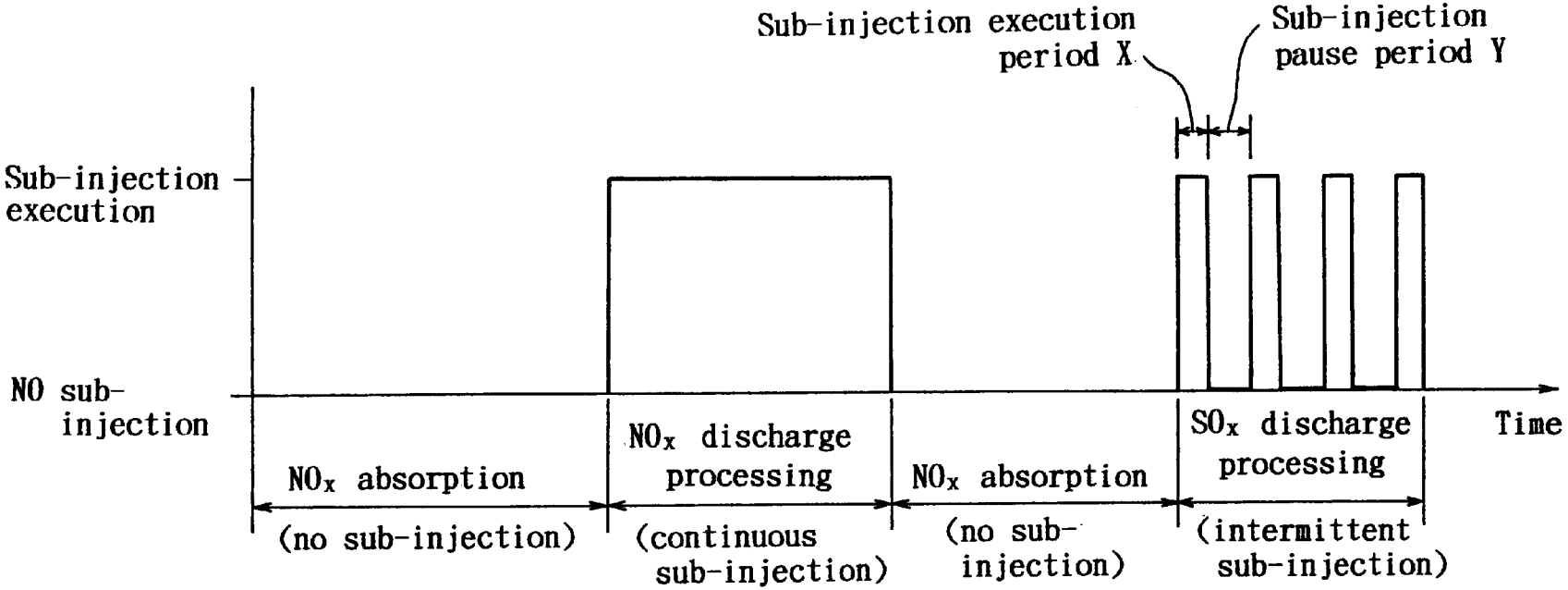
FIG. 15 is a timing chart for the fuel sub-injection control in the fourth embodiment according to the present invention.

To avoid this, the fuel injection amount for conducting sub-injection once in $SO_x$ discharge processing is set larger than that in $NO_x$ discharge processing to provide the richer air-fuel ratio of the exhaust gas than in $NO_x$ discharge processing. At the same time, as shown in FIG. 15, sub-injection processings are executed intermittently (or in a spike manner) to provide an atmosphere under which the inflowing exhaust gas has a stoichiometric or rich air-fuel ratio as a whole and under which a predetermined amount of oxygen exists at a downstream end of the catalytic converter 11. The atmosphere under which the inflowing exhaust gas has a stoichiometric or rich airflow rate as a whole and a predetermined amount of oxygen exists, is referred to as 'total rich atmosphere' hereinafter.

The ECU 20 then determines a fuel amount for sub-injection and an oxygen amount to be supplied during $SO_x$ discharge processing based on the catalyst bed temperature which is substituted by the exhaust gas temperature detected by the exhaust temperature sensor 29 as well as the oxygen concentration and reducing agent concentration of the exhaust gas discharged from the engine 1, so as to provide the total rich atmosphere up to the downstream end of the catalytic converter 11.

As for the intermittent sub-injection method to provide the total rich atmosphere up to the downstream end of the catalytic converter 11, there are proposed a method for setting a sub-injection execution period X shorter than a sub-injection pause period Y and supplying a reducing agent in a spike manner into an exhaust gas having a lean air-fuel ratio, and a method for setting a sub-injection execution period X longer than a sub-injection pause period Y and supplying oxygen in a spike manner into an exhaust gas having a rich air-fuel ratio.

If the intermittent sub-injection is executed and the total rich atmosphere is provided up to the downstream end of the catalytic converter 11 as described above, it is possible to discharge and reduce $SO_x$ absorbed by all of the $NO_x$ catalysts 10 in the catalytic converter 11 and discharge $SO_x$ as $SO_2$ to the air. It is noted that $NO_x$ absorbed by the $NO_x$ catalysts 10 is discharged and reduced, and then discharged as $N_2$ at a time of executing $SO_x$ discharge processing.

Even if intermittent sub-injection is executed for discharging $SO_x$ as stated above, there is a possibility that oxygen is consumed while the exhaust gas flows in the upstream region of the catalytic converter 11 if the temperature of the $NO_x$ catalyst 10 in the upstream region of the catalytic converter 11 is too high. To avoid this, $SO_x$ discharge processing may be executed when the temperature of the front end portion of the catalytic converter 11 decreases (such as, for example, during deceleration or idling operation) to allow ensuring an oxygen existing atmosphere in the downstream region of the catalytic converter 11. When the temperature of the front end portion of the catalytic converter 11 decreases, the temperature of the back end portion thereof increases. Thus, as $SO_x$ starts to be discharged and reduced from the $NO_x$ catalyst 10 at the back end and the temperature of the back end increases, the $SO_x$ discharge and reduction operation spreads to the front end portion of the catalytic converter 11.

As seen from the above, according to the exhaust discharge control device in this embodiment, it is possible to discharge and reduce the $SO_x$ absorbed by the $NO_x$ catalyst 10 surely and sufficiently. As a result, it is possible for the catalytic converter 10 to sufficiently recover its $NO_x$ absorbing capability.

In this embodiment, the fuel injection valve 7 and the ECU 20 for sub-injection control constitute regeneration means and rich atmosphere providing means.

In the above embodiment, intermittent sub-injection is employed as means for providing a total rich atmosphere up to the downstream end of the catalytic converter 11. In a fifth embodiment shown in FIG. 16, the total rich atmosphere is provided in the downstream region by conducting sub-injection continuously and supplying secondary air to the downstream region of the catalytic converter 11.

Figure 16:
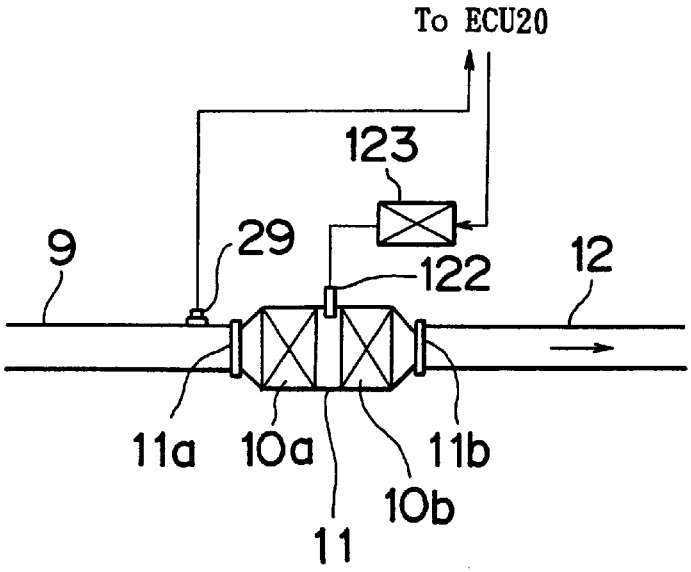
FIG. 16 is a block diagram showing an essential portion of an exhaust discharge control device in the fifth embodiment according to the present invention.

FIG. 16 shows only important parts of the catalytic converter 11 and does not show the remaining parts which are the same as those in the preceding embodiments.

In the catalytic converter 11 in this embodiment, an air supply nozzle 122 is interposed between an $NO_x$ catalyst 10*a* provided upstream of the converter 11 and an $NO_x$ catalyst 10*b* provided downstream thereof, to allow the secondary air supplied from an air supply unit 123 to be supplied to the $NO_x$ catalyst 10*b* in the downstream region. The operation of the air supply unit 123 is controlled by the ECU 20.

In this embodiment, sub-injection is conducted such that the air-fuel ratio of the exhaust gas is richer than that in $NO_x$ discharge processing. While continuously conducting sub-injection, secondary air is supplied from the air supply nozzle 122 to the downstream region of the catalytic converter 11. This makes it possible to provide a total rich atmosphere up to the downstream end of the catalytic converter 11 and to discharge and reduce $SO_x$ at the downstream end.

In addition, in case of conducting $SO_x$ discharge processing in the exhaust discharge control device with the above constitution, it is possible to first carry out $SO_x$ discharge processing for the $NO_x$ catalyst 10*b* downstream of the catalytic converter 11 and then for the $NO_x$ catalyst 10*a* upstream thereof. If $SO_x$ discharge processing is carried out for the downstream $NO_x$ catalyst 10*b*, secondary air is supplied from the air supply nozzle 122 to the downstream $NO_x$ catalyst 11*b* in a state where no or little oxygen exists in the exhaust gas flowing into the catalytic converter 11. If $SO_x$ discharge processing is carried out for the upstream $NO_x$ catalyst 10*a*, supply of secondary air from the air supply nozzle 122 is stopped to provide a state where oxygen contained in the exhaust gas flowing into the catalytic converter 11 increases in amount. It is noted that the air-fuel ratio of the exhaust gas during $SO_x$ discharge processing for the $NO_x$ catalysts 10*a* and 10*b* in both regions is set richer than that during $NO_x$ discharge processing.

In this embodiment, the air supply nozzle 122 and the air supply unit 123 constitutes oxygen supply means and rich atmosphere providing means.

Next, description will be given to a sixth embodiment in which the present invention is applied to a method of carrying out $SO_x$ discharge processing in the back flow direction of the exhaust gas in the catalytic converter 11 compared to the flow direction in $NO_x$ absorption processing or to a so-called back flow regeneration method.

The distribution of the amount of absorbed $SO_x$ in the catalytic converter 11 is larger as it is closer to the exhaust inlet side (front end side). Due to this, the following problem occurs. If the exhaust gas having a stoichiometric or rich air-fuel ratio flows in $SO_x$ discharge processing in the same direction as that in normal $NO_x$ absorption processing and $SO_x$ absorbed at the exhaust inlet side catalytic converter 11 is discharged, the discharged $SO_x$ is moved toward the exhaust outlet side (back end side) of the catalytic converter 11 and re-absorbed by the outlet side $NO_x$ catalyst.

To solve the above problem, a back flow regeneration method for flowing the exhaust gas having a stoichiometric or rich air-fuel ratio in $SO_x$ discharge processing in the opposite direction to that in $NO_x$ absorption processing has been developed. This method is based on the idea that as soon as $SO_x$ absorbed to the front end side of the catalytic converter 11 is discharged in a state in which the exhaust gas having a stoichiometric or rich air-fuel rate flows from the back end side of the catalytic converter 11 and then flows out of the front side thereof, $SO_x$ is discharged to the outside of the converter 11, thereby preventing the discharged $SO_x$ from being re-absorbed by the $NO_x$ catalyst in the catalytic converter 11.

Nevertheless, even if $SO_x$ discharge processing is carried out by the back flow regeneration method, oxygen in the exhaust gas is consumed at the back end side of the catalytic converter 11 before the exhaust gas having a stoichiometric or rich air-flow ratio reaches the $SO_x$ absorption region at the front end side of the catalytic converter 11. As a result, no oxygen exists in the $SO_x$ absorption region and the $SO_x$ dischargeable atmosphere cannot be provided in the $SO_x$ absorption region.

According to the present invention, it is possible to provide the $SO_x$ absorption region with the $SO_x$ dischargeable atmosphere even if $SO_x$ discharge processing is carried out using the back flow regeneration method stated above. Now, description will be given, referring to FIGS. 17 and 18. It is noted that sub-injection of fuel from the fuel injection valve 7 is not executed in this embodiment.

Figure 17:
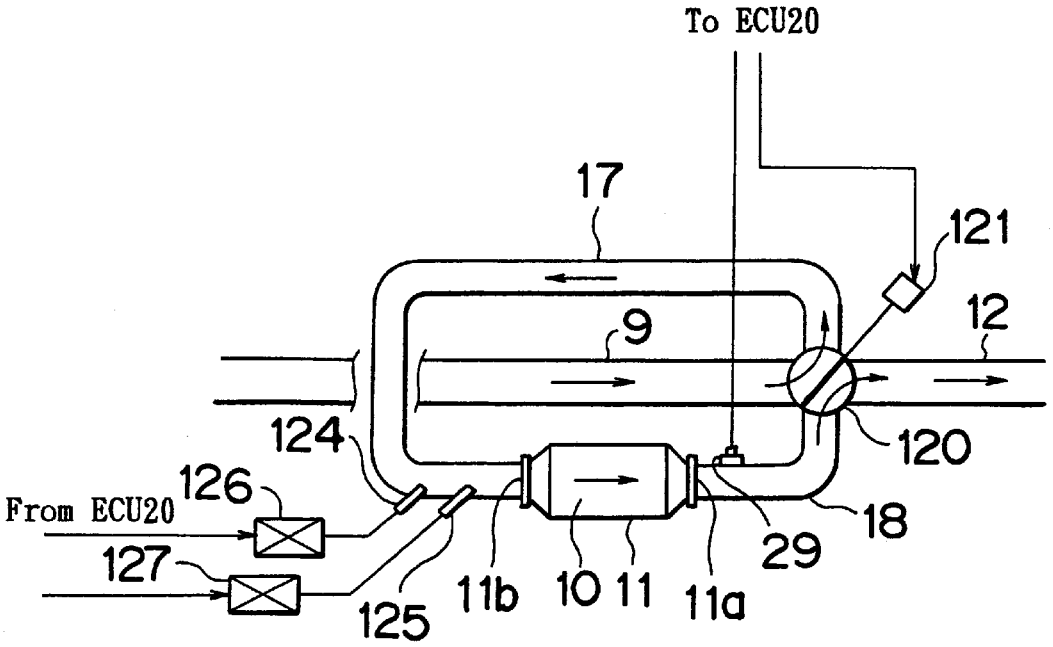
FIG. 17 is a block diagram showing an essential portion of an exhaust discharge control device in the sixth embodiment according to the present invention in the state where an exhaust directional control valve is located in a back flow position.

FIG. 17 shows that an exhaust pipe 9 is connected to the first port of an exhaust directional control valve (exhaust flow directional control valve) 120 including four ports. The second port of the exhaust directional control valve 120 is connected to an exhaust pipe 12 discharging an exhaust gas to the air, the third port thereof is connected to an inlet 11*a* of a catalytic converter 11 through an exhaust pipe 18 and the fourth port thereof is connected to an outlet 11*b* of the catalytic converter 11 through an exhaust pipe 17. An $NO_x$ catalyst (i.e., an occluding and reducing type $NO_x$ catalyst) 10 is contained in the catalytic converter 11.

Figure 18:
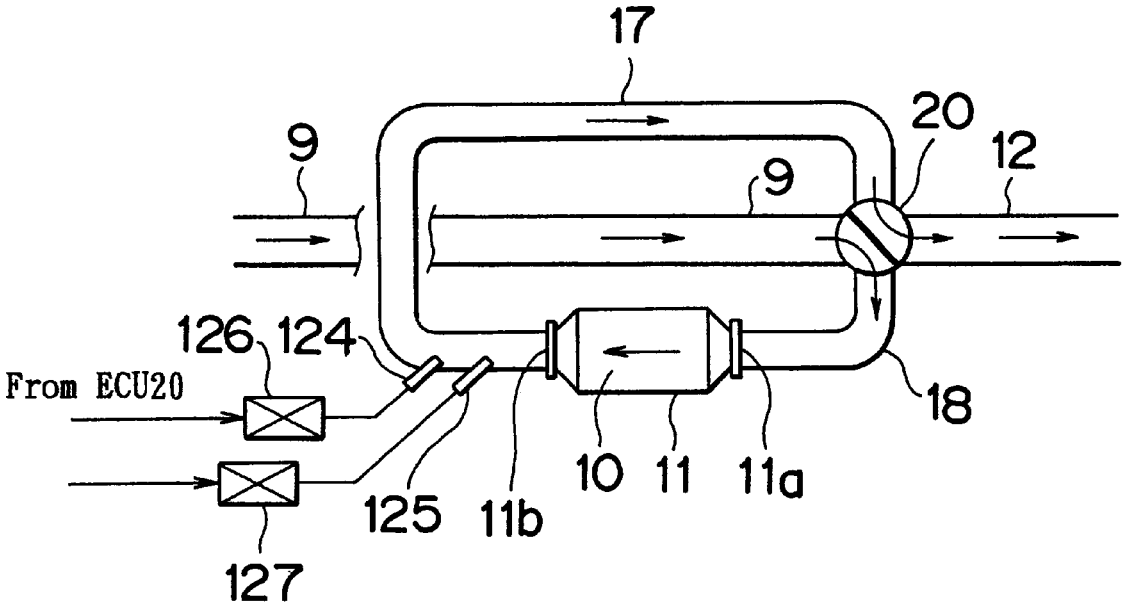
FIG. 18 shows an essential portion of the exhaust discharge control device in the sixth embodiment according to the present invention in the state where the exhaust directional control valve is located at the flow position.

The exhaust directional control valve 120 is provided to change the direction of the exhaust gas flowing through the catalytic converter 11 by switching a valve element between a fair flow position shown in FIG. 18 and a back flow position shown in FIG. 17. If the valve element is in the fair flow position shown in FIG. 18, the exhaust directional control valve 120 connects the exhaust pipes 9 and 18 and connects the exhaust pipes 12 and 17. At this moment, the exhaust gas flows through the exhaust pipe 9 the exhaust pipe 18 the catalytic converter 11 the exhaust pipe 17 the exhaust pipe 12 in this order and discharged to the air. The direction in which the exhaust gas flows from the inlet 11*a* of the catalytic converter 11 toward the outlet 11*b* thereof is referred to as "fair flow" direction hereinafter. If the valve element of the exhaust directional control valve 120 is in the back flow position shown in FIG. 17, the exhaust directional control valve 120 connects the exhaust pipes 9 and 17 and connects the exhaust pipes 12 and 18. At this moment, the exhaust gas flows through the exhaust pipe 9 the exhaust pipe 17 the catalytic converter 11 the exhaust pipe 18 the exhaust pipe 12 in this order and discharged to the air. The direction in which the exhaust gas flows from the outlet 11*b* of the catalytic converter 11 toward the inlet 11*a* is referred to as "back flow" direction hereinafter.

The exhaust directional control valve 120, which is driven by an actuator 121, switches the valve position. The actuator 121 is controlled by an ECU 20. The controlling of the position of the exhaust directional control valve 120 will be described later in more detail.

An exhaust temperature sensor 29 which outputs an output signal, corresponding to the temperature of an exhaust gas flowing through the catalytic converter 11, to the ECU 20 is provided at the exhaust pipe 18 in the vicinity of the inlet 11*a* of the catalytic converter 11.

A reducing agent supply nozzle 124 and an air supply nozzle 125 are provided at the exhaust pipe 17 upstream of the outlet 11*b* of the catalytic converter 11. The reducing agent supply nozzle 124 injects fuel (light oil) serving as a reducing agent supplied from the reducing agent supply unit 126 into the exhaust gas flowing through the exhaust pipe 17. The air supply nozzle 125 injects secondary air supplied from the air supply unit 127 into the exhaust gas flowing through the exhaust pipe 17. The operation of the reducing agent supply unit 126 and that of the air supply unit 127 are controlled by the ECU 20 to be described in detail.

In addition, an input signal from the depressing degree sensor 33 and that from revolution number sensor 15 are inputted to the input port of the ECU 20 as in the case of the preceding embodiment shown in FIG. 9.

Next, the description will be given to the function of an exhaust discharge control device in this embodiment. First, if $NO_x$ in the exhaust gas is absorbed by the $NO_x$ catalyst 10, the EPU 20 controls the actuator 121 such that the valve element of the exhaust directional control valve 120 is kept in the fair flow position shown in FIG. 18 and the flow direction of the exhaust gas in the catalytic converter 11 is the fair flow direction in which the exhaust gas flows from the inlet 11*a* toward the outlet 11*b*. If the exhaust gas is flown in the fair flow direction, $NO_x$ absorption starts at the $NO_x$ catalyst 10 at a side closer to the inlet 11*a* of the catalytic converter 11 and gradually spreads toward the $NO_x$ catalyst 10 at a side closer to the outlet 11*b*.

If $NO_x$ discharge processing is executed, the ECU 20 controls the actuator 121 such that the valve element of the exhaust directional control valve 120 is kept in the fair flow position shown in FIG. 18 and that the flow direction of the exhaust gas in the catalytic converter 11 is the same as that in the $NO_x$ absorption processing. The ECU 20 then controls the operation of the reducing agent supply unit 126 such that the air-fuel ratio of the exhaust gas flowing into the catalytic converter 11 satisfies predetermined rich or stoichiometric conditions. During the $NO_x$ discharge processing, fuel is continuously supplied from the reducing agent supply nozzle 124. By causing the exhaust gas having the stoichiometric or rich fuel-air ratio to flow into the catalytic converter 11, $NO_x$ absorbed in the $NO_x$ catalyst 10 is discharged, reduced and then discharged to the air as $N_2$.

If $SO_x$ discharge processing is executed, the ECU 20 controls the actuator 121 such that the valve element of the exhaust directional control valve 120 is kept in the back flow position shown in FIG. 17 and that the flow direction of the exhaust gas in the catalytic converter 11 is the direction opposite to that in the $NO_x$ absorption processing (i.e., from the outlet 11*b* toward the inlet 11*a*). Besides, the ECU 20 controls the operation of the reducing agent supply unit 126 and that of the air supply unit 127 so as to provide a total rich atmosphere up to the end portion of the inlet 11*a* side of the catalytic converter 11.

To provide a total rich atmosphere up to the end portion of the inlet 11a side of the catalytic converter 11, either of the following two control methods may be adopted.

Fuel is continuously injected from the reducing agent supply nozzle 124, an exhaust gas containing no oxygen at a predetermined rich air-fuel ratio is continuously supplied to the catalytic converter 11 and, at the same time, secondary air is intermittently supplied from the air supply nozzle 125.

Alternatively, since the exhaust gas of the diesel engine 1 during normal operation is in a lean state where excessive oxygen exits, it is possible to intermittently supply fuel from the reducing agent supply nozzle 124 and to control the reducing agent supply amount so that the exhaust gas can have a predetermined air-fuel ratio richer than that in $NO_x$ discharge processing without supply of the secondary air from the air supply nozzle 125.

Further, in case of $SO_x$ discharge processing by means of the back flow regeneration method, it is advantages that the temperature of the upstream region of the catalytic converter 11 during $SO_x$ discharge processing is higher than that of the downstream region thereof so as to leave oxygen in the $SO_x$ absorption region.

Figure 19:
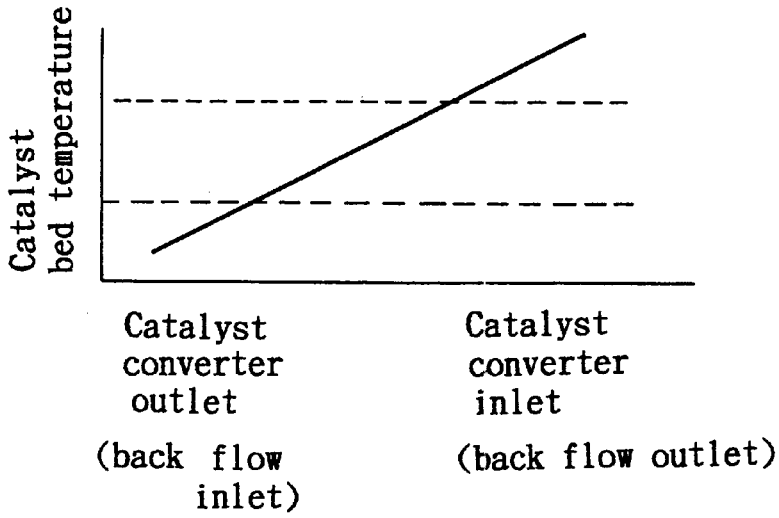
FIG. 19 shows an example of the temperature of a catalyst bed at the time of starting $SO_x$ discharge processing in the exhaust discharge control device in the sixth embodiment.

During $NO_x$ absorption conducted by setting the exhaust gas flow in the fair flow direction, the temperature of the catalytic converter 11 at the outlet 11*b* side is obviously lower than that at the inlet 11*a* side right after the temperature of the catalytic converter 11 at the inlet 11a side rises (e.g., immediately after acceleration). Therefore, by executing $SO_x$ discharge processing by means of back flow regeneration at this timing, it is easier to supply the reducing agent and oxygen toward the inlet 11*a* side at which $SO_x$ is absorbed. As shown in FIG. 19, if the catalysis temperature of the catalytic converter 11 at the inlet 11*a* is higher than a predetermined temperature window and that at the outlet 11*b* is lower than the temperature window, $SO_x$ discharge processing is preferably executed by means of back flow regeneration.

According to the exhaust discharge control device in this embodiment as in the preceding embodiments, it is possible to surely and sufficiently discharge and reduce $SO_x$ absorbed by the $NO_x$ catalyst 10, with the result that the catalytic converter 11 can recover its $NO_x$ absorbing capability sufficiently.

Additionally, in this embodiment, it is possible to switch the flow direction of the exhaust gas flowing through the catalytic converter 11 between the fair flow direction and the back flow direction only by switching the position of the valve element of a single exhaust directional control valve 120. Thus, the simple structure can be provided at low cost.

In this embodiment, the reducing agent supply nozzle 124 and the reducing agent supply unit 126 constitute regeneration means and rich atmosphere providing means, whereas the air supply nozzle 125 and the air supply unit 127 constitute rich atmosphere providing means.

Figure 20:
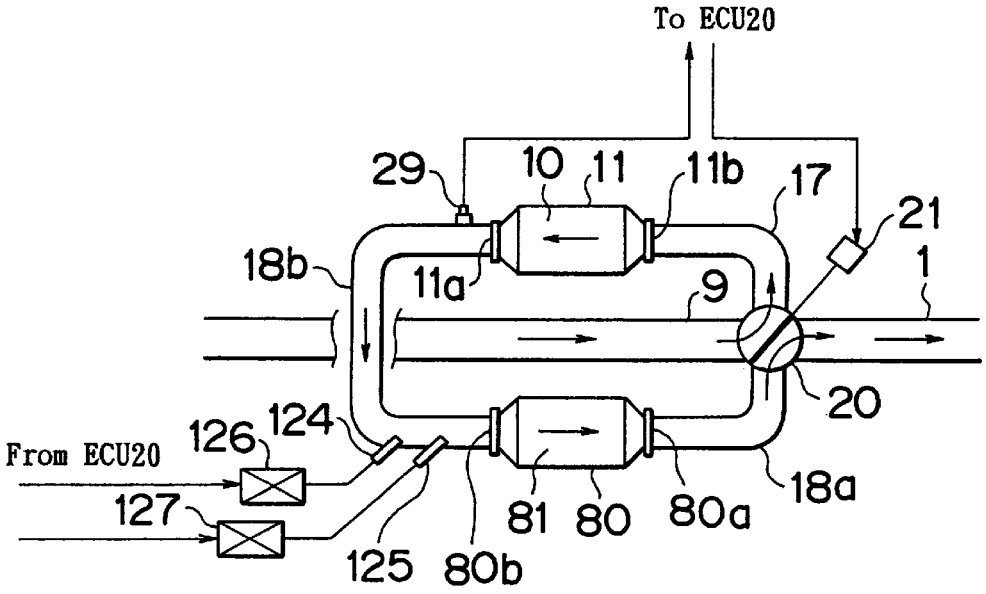
FIG. 20 is a block diagram showing an essential portion of the exhaust discharge control device in the seventh embodiment according to the present invention.

FIG. 20 shows the constitution of important parts of an exhaust discharge control device in a seventh embodiment.

The exhaust discharge control device in this embodiment is based on the constitution of the preceding embodiments and provided with an S trap 80 upstream of a catalytic converter 11. To be specific, the S trap 80 is disposed between exhaust pipes 18*a* and 18*b* connecting the third port of an exhaust directional control valve 120 and an inlet 11*a* of the catalytic converter 11. An S trap material 81 formed of an occluding and reducing type $NO_x$ catalyst having high $SO_x$ absorbing capability ($SO_x$ absorbent) 81 is housed in the S trap 80.

In the exhaust discharge control device in this embodiment, a reducing agent supply nozzle 124 and an air supply nozzle 125 are provided at the exhaust pipe 18*b* connecting an outlet 80*b* of the S trap 80 and the inlet 11*a* of the catalytic converter 11.

If the valve element of the exhaust directional control valve 120 is kept in a fair flow position, an exhaust gas discharged from an engine 1 is discharged to the air through the exhaust pipe 9 the exhaust pipe 18*a* the S trap 80 the exhaust pipe 18*b* the catalytic converter 11 the exhaust pipe 17 the exhaust pipe 12 in this order. At this moment, $SO_x$ in the exhaust gas is absorbed by the S trap 80 and hardly flows to the catalytic converter 11. The S trap 80, therefore, serves to prevent the $NO_x$ catalyst 10 in the catalytic converter 11 from being poisoned with $SO_x$. $NO_x$ in the exhaust gas is absorbed by the $NO_x$ catalyst 10 in the catalytic converter 11.

During $NO_x$ discharge processing, the flow direction of the exhaust gas is set in a fair flow direction as in the case of the preceding embodiments and fuel is injected from the reducing agent supply nozzle 124 into the exhaust gas passing through the S trap 80. As a result, the exhaust gas having a stoichiometric or rich air-fuel ratio flows into the converter 11 and $NO_x$ absorbed by the $NO_x$ catalyst 10 is thereby discharged and reduced.

During $SO_x$ discharge processing, as shown in FIG.20, the exhaust gas flows in the reverse flow direction and fuel is injected from the reducing agent supply nozzle 124 into the exhaust gas passing through the catalytic converter 11. Thus, the exhaust gas having a rich air-fuel ratio flows into the S trap 80 and $SO_x$ absorbed by the S trap material 81 in the S trap 80 is discharged and reduced.

In case of carrying out $SO_x$ discharge processing by means of the S trap 80, fuel is injected from the reducing agent supply nozzle 124 as in the case of carrying out $SO_x$ discharge processing in the preceding embodiments. That is to say, an EPU 20 controls the operation of the reducing agent supply unit 126 and that of the air supply unit 127 so as to provide a total rich atmosphere up to the end portion of the S trap 80 at the inlet 80*a* side.

The method for controlling the operation of the reducing agent supply unit 126 and that of the air supply unit 127 for purposes of providing a total rich atmosphere up to the end portion of the S trap 80 at the inlet 80*a* side, is the same as that in the preceding embodiments. The above-stated control can be also executed by either of the following control methods.

Fuel is continuously injected through the reducing agent supply nozzle 124, an exhaust gas containing no oxygen at a predetermined rich air-fuel ratio is continuously supplied to the S trap 80 and, at the same time, secondary air is intermittently supplied from the air supply nozzle 125.

Alternatively, since the exhaust gas of the diesel engine 1 during normal operation is in a lean state in which excessive oxygen exists, fuel is intermittently supplied from the reducing agent supply nozzle 124 and the reducing agent supply amount is controlled to be at a predetermined rich air-fuel ratio which is richer than that in the $NO_x$ discharge processing without supplying secondary air from the air supply nozzle 125.

In this embodiment, the reducing agent supply nozzle 124 and the reducing agent supply unit 126 constitutes regeneration means and rich atmosphere providing means, whereas the air supply nozzle 125 and the air supply unit 127 constitute rich atmosphere providing means.

Figure 21:
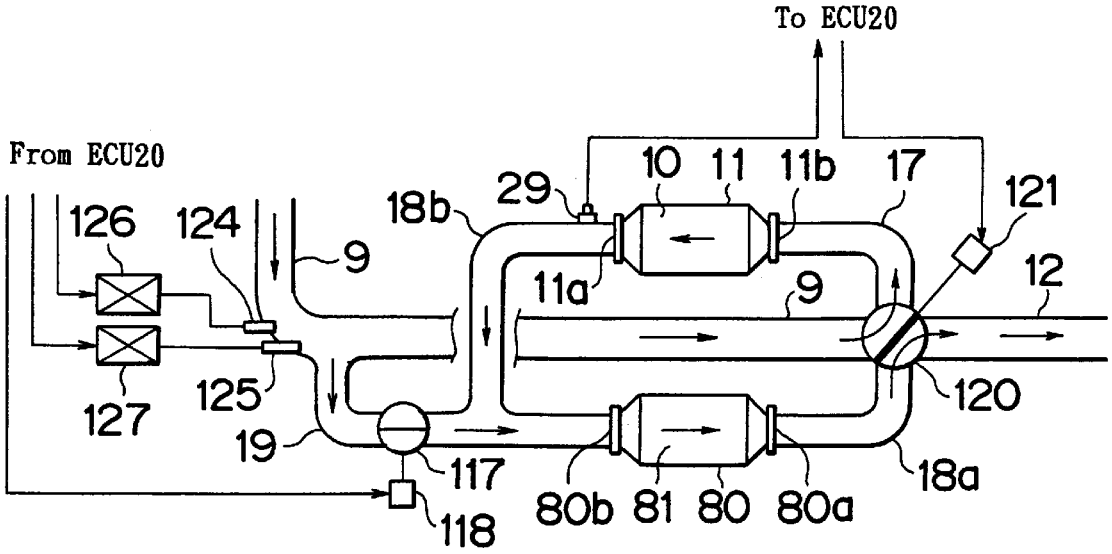
FIG. 21 is a block diagram showing an essential portion of the exhaust discharge control device in the eighth embodiment according to the present invention.

FIG. 21 shows the constitution of important parts of an exhaust discharge control device in the eight embodiment. The exhaust discharge control device in this embodiment is a modified version of the device in the seventh embodiment. The difference of the eight embodiment from the seventh embodiment will be described hereinafter.

In an eighth embodiment, exhaust pipes 9 and 18*a* are connected by an exhaust pipe 19 and an opening/closing valve 116 is provided midway of the exhaust pipe 19. The opening/closing valve 117 is opened/closed by an actuator 118, which is controlled by an ECU 20. A reducing agent supply nozzle 124 and an air supply nozzle 125 are provided at the exhaust pipe 9 upstream of a connection point between the exhaust pipes 9 and 19.

In this exhaust discharge control device, at a time of absorbing $NO_x$, the valve element of an exhaust directional control valve 120 is kept in a fair flow position and an opening/closing valve 117 is kept in an open state. This state is the same as that in $NO_x$ absorption processing in the seventh embodiment and the function thereof is also the same.

At a time of $NO_x$ discharge processing, the valve element of the exhaust directional control valve 120 is switched to the back flow position with the opening/closing valve 117 kept in a closed state. As a result, an exhaust gas turns into a back flow flowing through an S trap 80 after passing the catalytic converter 11. Fuel is injected from the reducing agent supply nozzle 124 into the exhaust gas, whereby the exhaust gas at the air-fuel ratio turned to be stoichiometric or rich flows into the catalytic converter 11 and $NO_x$ absorbed by the $NO_x$ catalyst 10 in the catalytic converter 11 is discharged and reduced. In the eighth embodiment, the reason for carrying out $NO_x$ discharge processing in back flow direction is that the fuel supplied from the reducing agent supply nozzle 124 is consumed at the S trap 80 before reaching the catalytic converter 11 if the exhaust gas flows in the back flow direction.

Next, at a time of $SO_x$ discharge processing, the opening/closing valve 117 is switched to an open state and the valve element of the exhaust directional control valve 120 is kept in a back flow position as shown in FIG. 21. By doing so, much of the exhaust gas flows from the exhaust pipe 9 to the exhaust pipe 19, to the exhaust pipe 12 through the S trap 80 and discharged to the air. In addition, some of the exhaust gas in small amount flows from the exhaust pipe 9 to the exhaust pipe 17, to the exhaust pipe 18*b* through the catalytic converter 11 and flows into the S trap 80. The flow rate of the exhaust gas flowing through the catalytic converter 11 is lowered because of the resistance of the catalytic converter 11.

During the $SO_x$ discharge processing, the ECU 20 controls the operation of the reducing agent supply unit 126 and that of the air supply unit 127 so as to provide a total rich atmosphere up to the end portion of the S trap 80 at the inlet 80*a* side by the fuel injection from the reducing agent supply nozzle 124.

As the method for controlling the operation of the reducing agent supply unit 126 and that of the air supply unit 127 for purposes of providing a total rich atmosphere up to the end portion of the S trap 80 at the inlet 80*a* side is the same as that in the seventh embodiment, the description will not be given herein.

Figure 22:
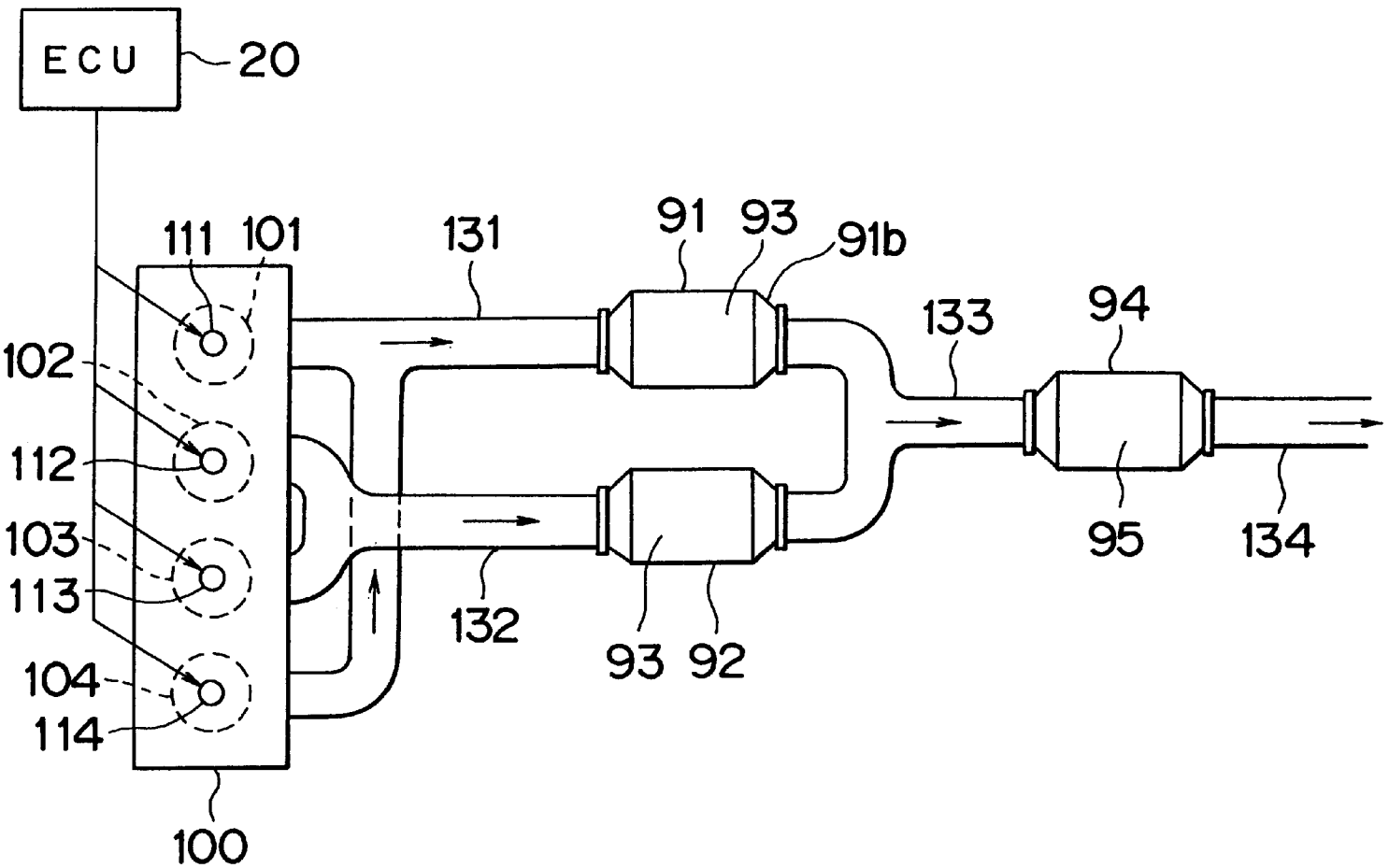
FIG. 22 is a block diagram showing an essential portion of an exhaust discharge control device in the ninth embodiment according to the present invention.

FIG. 22 is a schematically block diagram of en exhaust discharge control device for an internal combustion engine in a ninth embodiment according to the present invention.

The internal combustion engine in this embodiment is a lean burn gasoline engine. As is well known, the lean burn gasoline engine can, unlike the diesel engine, operate whether the air-fuel ratio of an exhaust gas in a combustion chamber is lean or rich. In this embodiment, therefore, the total rich atmosphere for an exhaust gas is realized by controlling the air-fuel ratio for combustion for every cylinder.

First, the constitution of this exhaust discharge control device will be described with reference to FIG. 22. An engine 100 is a serial four-cylinder lean burn gasoline engine (to be simply referred to as an 'engine' hereinafter) and intake air is supplied from intake pipes which are not shown to cylinders 101 to 104, respectively. In the engine 1, fuel injection valves 111, 112, 113 and 114 for injecting fuel in the vicinity of the compression top dead center are provided in the combustion chambers of the cylinders 101 to 104, respectively. The valve opening timing and period for each of the fuel injection valves 111 to 114 are controlled by the ECU 20 in accordance with the operating state of the engine 1.

The exhaust gas of the first cylinder 101 and that of the fourth cylinder 104 are discharged to the exhaust pipe 131, whereas the exhaust gas of the second cylinder 102 and that of the third cylinder 103 are discharged to the exhaust pipe 132. Catalytic converters 91 and 92 are provided at the exhaust pipes 131 and 132, respectively and an absorbing and reducing type $NO_x$ catalyst (to be referred to as '$NO_x$ catalyst' hereinafter) 93 is contained in each of the catalytic converters 91 and 92.

The exhaust gases passing through the catalytic converters 91 and 92 are discharged to the exhaust pipe 133, in which the exhaust gases discharged from the four cylinders 101 to 104 are combined. A catalytic converter 94 is provided at an exhaust pipe 133 and a well-known ternary catalyst 95 is housed in the converter 94. The exhaust gas passing through the catalytic converter 94 is discharged to the air through the exhaust pipe 134.

Next, the operation of this exhaust discharge control device will be described. In the exhaust discharge control device, the execution timing of $SO_x$ discharge processing is determined for the catalytic converters 91 and 92, irrespectively of each other. The $SO_x$ discharge processing execution timing is the same as that in the fourth embodiment and it may be set at the operating time of the engine 1 or may be determined by estimating the amount of $SO_x$ absorbed by each of the catalytic converters 91 and 92.

If $SO_x$ discharge processing is executed for the catalytic converter 91, the air-fuel ratios of the respective cylinders are controlled as follows. One of the first cylinder 101 and the fourth cylinder 104 is operated at a rich air-fuel ratio and the other is operated at a lean air-fuel ratio so that the total of the two cylinders, i.e., the first cylinder 101 and the fourth cylinder 104 have a rich air-fuel ratio. This makes it possible to provide a total rich atmosphere up to the end portion of the catalytic converter 91 at the outlet 91*b* side.

In addition, the reducing agent and oxygen are burned in the catalytic converter 91 and the temperature of the $NO_x$ catalytic 93 increases, so that catalysis temperature necessary for $SO_x$ discharge processing can be obtained. As a result, $SO_x$ and $NO_x$ absorbed by the catalytic converter 91 can be discharged and reduced.

While $SO_x$ discharge processing is executed for the catalytic converter 91, the second cylinder 102 and the third cylinder 103 are operated at a lean air-fuel ratio. At this time, $NO_x$ and $SO_x$ in the exhaust gases discharged from the second cylinder 102 and the third cylinder 103 are absorbed by the $NO_x$ catalyst 93 in the catalytic converter 92.

Furthermore, while $SO_x$ discharge processing is executed for the catalytic converter 91, the air-fuel ratios of the four cylinders 101 to 104 are controlled so as to make the air-fuel ratio of the exhaust gas in the exhaust pipe 83 at which the exhaust gases of the four cylinders 101 to 104 are combined, stoichiometric. By doing so, the reducing agent passing through the catalytic converter 91 in $SO_x$ discharge processing for the catalytic converter 91 is purified by the ternary catalyst 95 in the catalytic converter 9.

In this embodiment, the fuel injection valves 111 to 114 and the ECU 20 constitute regeneration means and rich atmosphere providing means (cylinder control means).

The invention claimed is:

1. An exhaust discharge control device for an internal combustion engine comprising:

an $NO_x$ absorbent located in an exhaust gas passage of the engine, wherein exhaust gas flows through the exhaust gas passage from upstream to downstream, the $NO_x$ absorbent absorbing $NO_x$ when an air-fuel ratio of exhaust gas flowing into the $NO_x$ absorbent is lean and discharging absorbed $NO_x$ when an oxygen concentration of the inflowing exhaust gas decreases;

oxygen concentration control means for allowing oxygen to remain in inflowing exhaust gas when one of $NO_x$ and $SO_x$ is to be discharged from the $NO_x$ absorbent and for maintaining the oxygen concentration of the exhaust gas within a predetermined range; and means for determining an amount of hydrocarbons adhered to the $NO_x$ absorbent, wherein the oxygen concentration control means increases the oxygen concentration of inflowing exhaust gas to increase an amount of one of $NO_x$ and $SO_x$ discharged from the $NO_x$ absorbent as the hydrocarbon amount increases.

2. An exhaust discharge control device for an internal combustion engine according to claim 1, further comprising means for detecting a temperature of the $NO_x$ absorbent, wherein the oxygen concentration control means increases the oxygen concentration of the exhaust gas flowing into the $NO_x$ absorbent to increase an amount of one of $NO_x$ and $SO_x$ discharged from the $NO_x$ absorbent as the temperature increases.

3. An exhaust discharge control device for an internal combustion engine according to claim 2, wherein the means for detecting the temperature of the $NO_x$ absorbent detects a temperature of the exhaust gas downstream of the $NO_x$ absorbent to obtain the temperature of the $NO_x$ absorbent.

4. An exhaust discharge control device for an internal combustion engine according to claim 1, wherein the $NO_x$ absorbent includes a hydrocarbon absorbent, the hydrocarbon absorbent absorbing hydrocarbon when a temperature of the hydrocarbon absorbent is below a predetermined temperature and releasing absorbed hydrocarbon when the temperature of the hydrocarbon absorbent is at least the predetermined temperature.

5. An exhaust discharge control device for an internal combustion engine according to claim 1, wherein the $NO_x$ absorbent includes an oxygen occluding material, the oxygen occluding material storing oxygen when the oxygen concentration of inflowing exhaust gas increases and discharging stored oxygen when the oxygen concentration of inflowing exhaust gas decreases.

6. An exhaust discharge control device for an internal combustion engine according to claim 5, wherein the $NO_x$ absorbent includes a hydrocarbon absorbent, the hydrocarbon absorbent absorbing hydrocarbons when a temperature of the hydrocarbon absorbent is below a predetermined temperature and releasing absorbed hydrocarbons when the temperature of the hydrocarbon absorbent is at least the predetermined temperature.

7. An exhaust discharge control device for an internal combustion engine according to claim 1, further comprising:

air-fuel ratio control means for temporarily lowering an air-fuel ratio of the exhaust gas flowing into the $NO_x$ absorbent and to discharge from the $NO_x$ absorbent the one of $NO_x$ and $SO_x$ absorbed therein.

8. An exhaust discharge control device for an internal combustion engine according to claim 7, wherein the engine includes a plurality of cylinders and wherein the air-fuel ratio control means increases a fuel injection quantity for a part of the plurality of cylinders.

9. An exhaust discharge control device for an internal combustion engine according to claim 7, wherein the air-fuel ratio control means conducts a fuel injection near a compression top dead center of the engine and a secondary injection in one of an engine expansion stroke and an engine exhaust stroke.

10. An exhaust discharge control device for an internal combustion engine comprising:

an occluding and reducing type $NO_x$ catalyst disposed in an exhaust gas passage of the engine, wherein exhaust gas travels through the exhaust passage from upstream to downstream, the occluding and reducing type $NO_x$ catalyst absorbing $NO_x$ in the exhaust gas flowing therein when an air-fuel ratio of inflowing exhaust gas is lean and discharging absorbed $NO_x$ therefrom when the air-fuel ratio of inflowing exhaust gas is one of stoichiometric and rich;

regeneration means for making the air-fuel ratio of in flowing exhaust gas one of stoichiometric and rich when $SO_x$ absorbed by the occluding and reducing type $NO_x$ catalyst during $NO_x$ absorption is discharged from the occluding and reducing type $NO_x$ catalyst;

rich atmosphere providing means for supplying and maintaining a predetermined amount of oxygen in an $SO_x$ absorption region of the occluding and reducing $NO_x$ catalyst when the regeneration means executes $SO_x$ discharge; and means for determining an amount of hydrocarbons adhered to the $NO_x$ catalyst, wherein the rich atmosphere providing means increases the oxygen concentration of inflowing exhaust gas to increase an amount of one of $NO_x$ and $SO_x$ discharged from the $NO_x$ catalyst as the hydrocarbon amount increases.

11. An exhaust discharge control device for an internal combustion engine according to claim 10, wherein a timing of $SO_x$ discharge execution by the regeneration means and the rich atmosphere providing means is controlled at a time at which a catalysis temperature of a downward region of the occluding and reducing type $NO_x$ catalyst in an exhaust gas flow direction during $SO_x$ discharge is higher than a catalysis temperature of an upward region of the occluding and reducing type $NO_x$ catalyst.

12. An exhaust discharge control device for an internal combustion engine according to claim 10, wherein said rich atmosphere providing means includes means for supplying oxygen to a catalyst downstream of the occluding and reducing type $NO_x$ catalyst during $SO_x$ discharge.

13. An exhaust discharge control device for an internal combustion engine according to claim 10, wherein said internal combustion engine is a multiple-cylinder internal combustion engine and said rich atmosphere providing means comprises means for burning fuel in a first portion of the cylinders at a rich air-fuel ratio and for burning fuel at a lean air-fuel ratio in a second portion of the cylinders.

14. An exhaust discharge control device for an internal combustion engine comprising:

an occluding and reducing type $NO_x$ catalyst disposed in an exhaust gas passage of the engine, wherein exhaust gas travels through the exhaust passage from upstream to downstream, the occluding and reducing type $NO_x$ catalyst absorbing $NO_x$ in the exhaust gas when an air-fuel ratio of inflowing exhaust gas is lean, and discharging absorbed $NO_x$ when the air-fuel ratio of inflowing exhaust gas is one of stoichiometric and rich;

an $SO_x$ absorbent arranged in said exhaust passage upstream of the occluding and reducing type $NO_x$ catalyst, the $SO_x$ absorbent absorbing $SO_x$ when the air-fuel ratio of inflowing exhaust gas is lean and discharging the absorbed $SO_x$ when the air-fuel ratio of inflowing exhaust gas is one of stoichiometric and rich;

regeneration means for making the air-fuel ratio of the exhaust gas one of stoichiometric and rich when the $SO_x$ previously absorbed by the $SO_x$ absorbent is to be discharged from the $SO_x$ absorbent;

rich atmosphere providing means for controlling an oxygen content of inflowing exhaust gas so that a predetermined amount of oxygen enters an $SO_x$ absorption region of said $SO_x$ absorbent when the regeneration means executes $SO_x$ discharge; and means for determining an amount of hydrocarbons adhered to the $NO_x$ catalyst, wherein the rich atmosphere providing means increases the oxygen concentration of inflowing exhaust gas to increase an amount of one of $NO_x$ and $SO_x$ discharged from the $NO_x$ catalyst as the hydrocarbon amount increases.

15. An exhaust gas discharge control device for an internal combustion engine according to claim 14, wherein said rich atmosphere providing means includes means for supplying oxygen to said $SO_x$ absorbent.

* * * * *